US010347439B2

(12) United States Patent
Andaluz Sorlí

(10) Patent No.: US 10,347,439 B2
(45) Date of Patent: Jul. 9, 2019

(54) HIGH THERMAL EFFICIENCY ELECTRIC SWITCH AND METHOD FOR INTERRUPTING ELECTRIC CURRENT

(71) Applicant: GORLAN TEAM, S.L.U., Lemoa (ES)

(72) Inventor: Jose Oscar Andaluz Sorlí, Saragossa (ES)

(73) Assignee: Gorlan Team, S.L.U., Lemoa (Vizcaya) (ES)

( * ) Notice: Subject to any disclaimer, the term of this patent is extended or adjusted under 35 U.S.C. 154(b) by 0 days.

(21) Appl. No.: 15/664,454

(22) Filed: Jul. 31, 2017

(65) Prior Publication Data

US 2018/0019076 A1 Jan. 18, 2018

Related U.S. Application Data

(63) Continuation of application No. 15/125,129, filed as application No. PCT/ES2014/070831 on Nov. 7, 2014, now Pat. No. 9,899,159.

(51) Int. Cl.

| | |
|---|---|
| ***H01H 1/36*** | (2006.01) |
| ***H01H 9/02*** | (2006.01) |
| ***H01H 9/40*** | (2006.01) |
| ***H01H 15/10*** | (2006.01) |
| ***H01H 15/20*** | (2006.01) |
| ***H01H 19/56*** | (2006.01) |

(52) U.S. Cl.

CPC ..... *H01H 9/40* (2013.01); *H01H 1/36* (2013.01); *H01H 9/02* (2013.01); *H01H 15/10* (2013.01); *H01H 15/20* (2013.01); *H01H 19/56* (2013.01)

(58) Field of Classification Search

CPC ..... H01H 1/36; H01H 15/10; H01H 15/20; H01H 15/04; H01H 1/58; H01H 1/2041; H01H 9/40; H01H 73/18

USPC ..... 218/2, 4, 94, 12; 361/2, 8; 200/8 A, 10

See application file for complete search history.

(56) References Cited

U.S. PATENT DOCUMENTS

| | | | |
|---|---|---|---|
| 3,120,585 | A | 2/1964 | Harris, Jr. et al. |
| 3,534,226 | A | 10/1970 | Lian |
| 4,442,469 | A | 4/1984 | Yanabu |
| 4,488,021 | A | 12/1984 | Yoshizumi |
| 5,777,286 | A | 7/1998 | Abot et al. |

(Continued)

FOREIGN PATENT DOCUMENTS

| | | | |
|---|---|---|---|
| EP | 0117914 | A2 | 9/1984 |
| EP | 2667394 | A1 | 11/2013 |

*Primary Examiner* — Edwin A. Leon

*Assistant Examiner* — William A Bolton

(74) *Attorney, Agent, or Firm* — Knobbe, Martens, Olson & Bear, LLP

(57) ABSTRACT

An electric switch includes a first and a second connection terminal for connecting the switch to an external circuit; a first switch assembly, which includes two or more electric breaker elements connected in series to one another and to the first and the second connection terminal; a second switch assembly, which includes at least one delayed electric breaker element connected in parallel to the first switch assembly. A moving actuator is made of insulating material and is associated with the first and the second switch assembly to open or close them. The moving actuator is movable between a closed switch position in which electrical continuity is established between the first and the second connection terminal, and an open position in which current flow between said terminals is prevented.

22 Claims, 30 Drawing Sheets

(56) References Cited

U.S. PATENT DOCUMENTS 8,081,407 B2 12/2011 Willieme
9,899,159 B2 * 2/2018 Andaluz Sorli ..... H01H 9/40

* cited by examiner

FIG. 10C
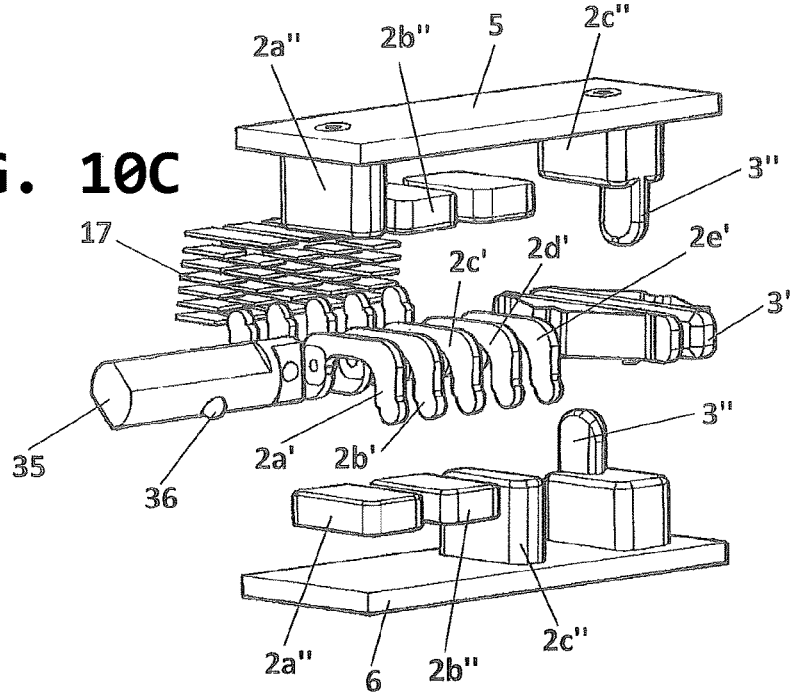
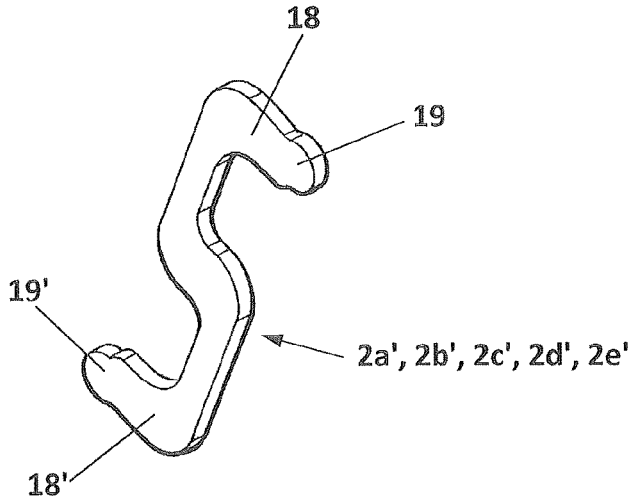
FIG. 10D 5
3''
3'
Y
6
d=2mm
75°
X
It
Ib
Ia
2a''
2b''
2c''
2a'
2b'
2c'
2d''
2e'
It=Ia+Ib
Ib=0
Ia=It 5
6
2a'
2b'
2c'
2a''
2b''
2c''
3'
3''
It
Ia
Ib
It=Ia+Ib
It=Ib
Ia=0
110°
X
Y

HIGH THERMAL EFFICIENCY ELECTRIC SWITCH AND METHOD FOR INTERRUPTING ELECTRIC CURRENT

CROSS-REFERENCE TO RELATED APPLICATIONS

This application is a Continuation of U.S. application Ser. No. 15/125,129, filed on Sep. 9, 2016 as the U.S. National Phase under 35 U.S.C. § 371 of International Application PCT/ES2014/070831, filed Nov. 7, 2014. The disclosure of the above-described application are hereby incorporated by reference in its entirety.

OBJECT OF THE INVENTION

The present invention is comprised in the field of electric switches and/or disconnect switches, particularly adapted for quenching the electric arc formed when the contacts thereof open and close.

One object of the present invention is to provide a small-sized electric breaker switch that rapidly and effectively extinguishes electric arcs formed in an electrical circuit during transient current interruption and closing operations.

Another additional object of the present invention is to provide a high thermal efficiency electric, i.e. more energy-efficient, breaker switch because it reduces power losses due to heating during the electrical conduction permanent state.

Another additional object of the present invention is to provide a method for controlling electric current flow, i.e., interrupting and allowing current flow, by means of an electric switch device, such that the same device rapidly and effectively quenches electric arcs formed during transient current interruption and closing operations, and at the same time the electrical conduction permanent state shows high thermal efficiency.

The switch and method of the invention are particularly applicable to high power direct current interruption, where quenching the electric arc is more complicated than in alternating current interruption.

BACKGROUND OF THE INVENTION

Electric arcs or voltaic arcs formed in electrical circuits are known to cause many problems today because the heat energy produced during an electric arc is highly destructive. Some of these problems are: deterioration of the switch material, breakdowns and/or complete or partial destruction of electrical installations, including damage to people caused by burns or other types of injuries.

The problems in quenching electric arcs are particularly pronounced in direct current interruption where, unlike with alternating current, there is no zero-crossing, so an arc forms and it must be eliminated as quickly as possible by means of deionizing the medium and increasing dielectric strength.

Several techniques are known today for extinguishing electric arcs formed when the contacts in a breaker switch or disconnect switch open and close. The common objective shared by all these techniques is for the energy dissipated in the heat of the electric arc to be as little as possible, with the ultimate goal of being nil. To that end, time control is the critical variable that is acted on so that the rate of extinction of the electric arc is as rapid as possible.

Several techniques are known to meet said objective, among which the following must be pointed out:

a) Increase in the gap between the fixed and moving contacts of the electric switch, which involves a larger volume of air between them and therefore a larger size of the switch.

Increase in speed of tripping devices.

Radial interruption.

Connecting simultaneous contacts in series.

b) Increase in length or "elongation" of the electric arc for one and the same instant in time.

Spark quenching chambers.

Magnetic and pneumatic blowout.

c) Cooling the electric arc using auxiliary means to reduce harmful heat effects, such as for example the use of pressurized sulfur hexafluoride $SF_6$.

d) Acting on the dielectric strength of the medium to prevent the arc from lighting up again because of the influence of the electric field due to differences in potential.

However, though there are currently electric breaker switches combining some of the techniques mentioned above, i.e., spark quenching chamber with magnetic or pneumatic blowout, radial rather than linear separation of contacts, etc., said switches today still do not satisfactorily solve their main function of quenching electric arcs, because the quenching time is still too long and material is still subject to deterioration, particularly in very demanding applications such as high power direct current interruption.

Furthermore, techniques known for quenching arcs generally involve an increase in the volume of the switches due to the volume of air needed between contacts.

Operation of switch breaker mechanisms usually involves some type of impact between parts, which in the long-term causes deterioration due to material wear which can lead to destruction of the switch.

On the other hand, as the power and intensity which passes through a switch increases, it is necessary to:

optimize current interruption technology.

increase the size of switches. This technique is illustrated in FIG. 1 and is used by most manufacturers of switches of this type. It consists of adding poles, i.e., an electric junction assembly between fixed and moving contacts, in series, such that they allow splitting the arc into smaller loads (same intensity, less voltage between the contacts of each pole), so it is easier to quench the electric arc that is formed.

In relation to the diagram of FIG. 1, it can be seen in a more detailed manner that the technique discussed above consists of replacing a simple switch (1) such as that shown in FIG. 1A consisting of a single breaker element (2), with a switch (1) consisting of multiple breaker elements (2, 2", 2''') connected in series as shown in FIG. 1B.

The advantages of connecting the poles in series as shown in FIG. 1B are listed below:

Splitting the arc into smaller loads makes interrupting it easier.

Splitting the electric arc increases the electrical endurance (life cycle) of the contacts because they are subjected to less power and therefore suffer less and deteriorate less.

However, there are also drawbacks associated with said connection in series:

It is necessary to increase the size of the switch to house more poles.

A larger amount of conductive material is used.

The working temperature increases as there are 2, 3 or more poles connected in series withstanding the same current as one pole.

Energy consumption increases because each pole is equivalent to a resistance and since the poles are grouped in series, an equivalent final resistance equal to the sum of all resistances is obtained. Therefore, by applying Joule's law ($P=I^2R$) the power increases in a directly proportional manner. If resistance is three times greater, the heat output due to Joule's effect is three times greater.

As can be seen, the advantages of connecting the poles in series contribute to optimizing the dynamic state, i.e., when the electric arc is interrupted; however, it involves an enormous drawback in the idle or permanent state they are in for 95% of their service life, which entails greater energy consumption.

In relation to the conductive materials used in a switch from the state of the art, since the contacts have to perform both functions, i.e., transient and permanent states, an agreement has to be met in choosing the materials and oversizing them to prolong service life. Materials that are good electrical conductors are generally used, but those materials are soft and poorly arc resistant, so they require external coatings or treatments to improve their arc resistance and increase their melting temperature. This increases manufacturing costs, and the chosen material is never optimal for both the transient and permanent states.

Energy consumption of a switch is produced by heat losses caused by Joule's effect due to its internal resistance, a value which is directly related to the design and the conductive materials used.

$$E=P\cdot t=R\cdot I^2\cdot t$$

Where:

E is energy; P is electric power; t is time; R is electrical resistance, and I is electric intensity.

DESCRIPTION OF THE INVENTION

The drawbacks described above are solved by means of the present invention, providing an electric breaker switch which rapidly and effectively interrupts the electric arc, in a small space, while at the same time having low power losses due to heating during the electrical conduction permanent state.

The invention is based on providing a switching device that behaves differently during transient electric current interruption and connecting periods and in the electrical conduction permanent state once the transient period has concluded, such that in the transient period the current is made to flow through several electric interruption points connected in series to therefore aid in quenching arcs in switch closing and opening operations, whereas in permanent operating periods the current is made to flow through a breaker element having a low electrical resistance so that power losses are reduced.

To that end, a first aspect of the invention relates to an electric switch device comprising at least a first and a second connection terminal for connecting the switch to an external circuit for the purpose of interrupting and allowing electric current flow, whether it is a direct or alternating current, through said circuit.

The switch incorporates a first switch assembly comprising two or more electric breaker elements, i.e., switches of any type, connected in series to one another and to said first and second connection terminal, and where the first switch assembly is constructed such that its electric breaker elements can operate at the same time, i.e., they open and close simultaneously. Each electric breaker element comprises at least two fixed contacts and one moving contact which can be connected to and disconnected from the respective fixed contacts to close or open the electric breaker element and thus allow or prevent current flow through same.

Furthermore, the switch incorporates a second switch assembly connected in parallel to the first switch assembly, such that this second switch assembly is adapted so that it has less electrical resistance than the first. To that end, this second switch assembly comprises a smaller number of electric breaker elements than the first switch assembly, therefore having less electrical resistance than the first switch assembly.

Alternatively, it is possible for the second switch assembly to have less resistance than the first switch assembly in any manner known by a person skilled in the art, for example, by connecting several electric breaker elements to one another in parallel and/or by choosing conductive materials having a low electrical resistance.

The second switch assembly preferably has a single breaker element connected in parallel to all the breaker elements in series of the first switch assembly. The breaker element of the second switch assembly comprises two fixed contacts connected respectively to the two connection terminals of the switch, and a moving contact that can be connected to and disconnected from said two fixed contacts to establish or prevent electrical continuity through same. The second switch assembly can alternatively be formed by several electric breaker elements connected in parallel to one another for the purpose of reducing electrical resistance even further reducing losses.

The switch also incorporates a moving actuator made of electrically insulating material, which is functionally associated with the first and the second switch assembly to open or close them, and such that the moving actuator is operable from outside the switch, whether manually or by means of any type of mechanism.

The moving actuator is configured and mounted in the switch such that it can move with at least one linear movement component along an axis X. In a possible embodiment, the moving actuator is configured for moving, defining only one linear movement along said axis X. In another preferred embodiment, the actuator is configured for moving helically with respect to said axis X, so said helicoidal movement is the combination of a linear movement component with respect to the axis X, together with a simultaneous rotational movement component with respect to the same axis X, i.e., the actuator rotates about the axis X while at the same time it moves forward along said axis X.

In another preferred embodiment of the invention, the moving actuator is configured for moving rotationally on one and the same plane and about an axis, whereby the actuator is movable defining a movement with a single movement component, in this case an angular movement component.

The moving contacts of the first and the second switch assembly are mounted in said moving actuator, such that they are all jointly movable with the same movement of the actuator.

To interrupt or allow electric current flow, the switch is actuated by means of the actuator, so the actuator is configured and mounted in the switch such that it can perform a closing operation, moving to an end position of said operation, in which electrical continuity is established between the first and the second connection terminal through the first and/or the second switch assembly, and a opening operation with a movement opposite the previous movement, in which current flow between said terminals is prevented in an end position of said operation.

To perform these connections and disconnections, the fixed contacts are placed in a suitable position so that current is interrupted or connected with the associated moving contact. The person skilled in manufacturing such electric switches is familiar with the design thereof and is able to suitably position and size the fixed and moving contacts to perform the operations described above.

The second switch assembly is configured for being closed in the electrical switch closing operation, after the first switch assembly closes, such that the first switch assembly is short-circuited by the second switch assembly. Preferably, all the breaker elements offer similar electrical resistance, and since the second switch assembly has fewer breaker elements connected to one another in series than the first switch assembly (shorter length of conductive material through which current must flow), it has less electrical resistance so when the second switch assembly closes, current passes through the second switch assembly instead of through the first switch assembly.

The switch is designed such that the lag time between closing the first and the second switch assembly is equal to or greater than the transient time for quenching electric arcs. Therefore in the switch closing operation during a transient period, first the breaker elements of the first switch assembly close so the arc is split into several interruption points, and once the transient has elapsed and the arc has been quenched, the second switch assembly is connected so that current passes through same during the switch use permanent state and therefore reduces power losses.

In the reverse operation to open the switch, first the second switch assembly opens so current then flows in its entirety through the first switch assembly, and the first switch assembly finally opens.

To obtain said lag between closing the second and the first switch assembly, the fixed contacts and/or the moving contact of the second switch assembly are simply positioned and sized to obtain said lag time, taking into account that all the moving contacts of the switch are mounted in the moving actuator and therefore move at the same time and therefore with the same speed.

The person skilled in the art will understand that there are many ways to achieve said lag depending on the type of switch and nominal working values thereof, and that the design of the switch for obtaining said lag falls within the daily practice of the skilled person. It is generally necessary for the second switch assembly to be configured by positioning and sizing its fixed contacts and/or its moving contact, such that the maximum path (the position with the largest gap between both) which the moving contact of the second switch assembly must travel until contacting with its respective fixed contacts is longer than the maximum path that the moving contacts of the first switch assembly must travel until contacting with its fixed contacts, such that in the electrical switch closing operation, the second switch assembly takes longer to close than the first switch assembly, taking into account that all the moving contacts move at the same time as they are integral with the moving actuator.

The aforementioned maximum path refers to the longest path a moving contact must travel until contacting with its respective fixed contacts.

In other preferred embodiments, the lag can be obtained by placing the fixed contacts of the second switch assembly further back in relation to the position of its moving contact. In other preferred embodiments, it can be of interest to keep the fixed contacts of the second switch assembly in a position similar to that of the fixed contacts of the first switch assembly, and in contrast to modify the position of the moving contact of the second switch assembly. In other embodiments, the moving contacts can be actuated at the same time, for example by means of a system of cams or apertures in a drum, such that the delayed moving contact of the second switch assembly moves more slowly than the moving contacts of the first switch assembly.

Another aspect of the invention relates to a method for controlling current flow through an electric line, i.e., interrupting or allowing current flow, by means of using a switching device, such as the switch described above for example.

Said method comprises connecting (or having connected) in series in said line a first switch assembly formed by two or more electric breaker elements connected to one another in series, and connecting (or having connected) a second switch assembly in parallel to the first switch assembly, where said second switch assembly has less electrical resistance than the first switch assembly. In a line closing operation to allow current flow, breaker elements of the first switch assembly simultaneously close while the second switch assembly is kept open, thereby allowing current flow through the electric line and thus more easily quenching the arc with the multiple interruption points of the first switch assembly. After an established time period long enough to quench the arc, the second switch assembly closes to short-circuit the first switch assembly, and since the second switch assembly has less electrical resistance, current then flows through the second switch assembly.

Once the second switch assembly is closed, the breaker elements of the first switch assembly can stay closed or be open, depending on the type of switch, i.e., rotary switch, linear switch, etc.

In a line opening operation to interrupt current flow, the method comprises opening the second switch assembly while the breaker elements of the first switch assembly are closed, such that the current in the line then flows in its entirety through the first switch assembly, and then in the method the breaker elements of the first switch assembly open simultaneously to interrupt current flow through the electric line.

The second switch assembly comprises an electric breaker element, and the electric breaker elements of the first and the second switch assembly respectively comprise at least two fixed contacts and one moving contact that can be connected with the associated fixed contacts. The method comprises simultaneously moving the moving contacts of the electric breaker elements of the first and the second switch assembly.

To get the second switch assembly to have less resistance than the first, the second switch assembly has fewer breaker elements in series than the second switch assembly, and therefore shorter length of conductive material through which electric current must flow, and therefore it has less electrical resistance. The second switch assembly preferably has a single electric breaker element, and the first switch assembly has two or more breaker elements, where all the breaker elements have an identical or substantially similar electrical resistance. To improve electrical resistance, the second switch assembly could have several electric breaker elements connected to one another in parallel, which involves an increase in section and reduces electrical resistance.

Furthermore, the method of the invention comprises actuating the first and the second switch assembly by means one and the same actuating element, specifically by means of a moving actuator common to both switch assemblies. The successive connection of the first and the second switch assembly is thereby obtained in the same operation, i.e., with a single movement, so the switch can be actuated with one and the same mechanism outside the device and in a conventional manner.

To that end, both in the switch and in the method of the invention, the moving parts of the breaker elements, i.e., the moving contacts thereof, are mounted in the same moving actuator, so they all move at the same time. The moving actuator can comprise a single body, or the moving actuator can alternatively comprise two different bodies coupled to one another and jointly movable, such that one body can make one type of movement to move the moving contacts of the first switch assembly, and the other body can make another type of movement to move the moving contact of the second switch assembly.

In a preferred embodiment, the method of the invention comprises moving the moving contacts of the first and the second switch assembly simultaneously with a linear movement component along an axis (X). In another preferred embodiment, the method of the invention comprises moving the moving contact of the second switch assembly rotationally on one and the same plane and about an axis (X), and simultaneously moving the moving contacts of the first switch assembly helically with respect to that axis (X), or rotationally on one and the same plane and about an axis (X), which allows optimizing the function of each type of switch, as explained above.

All these functions are performed with a single switch opening or closing movement like any conventional switch from the state of the art because all the moving contacts are movable by means of the same body, the moving actuator, i.e., it is the switch itself that which internally modifies the connection of the contacts as a result of the configuration of their contacts.

In the conception of the present invention, it has been seen that the greatest environmental impact within the life cycle of an electric switch occurs during use; once it is installed, the only way to interact with the environment is through energy consumption, despite being a stationary element. The use of a switch throughout its life cycle can be divided into two states:

Permanent or idle state: the switch makes contact, i.e., current passes through the switch continuously. The switch is in this state for most of its service life (95% on average).

Dynamic or transient state: the switch interrupts current. There is high instantaneous consumption, but this state involves at most 5% of its service life.

As stated, the switch is in the permanent state for most of its life, so this is where the greatest potential can be found in terms of energy efficiency and savings in energy consumption. This particularity has been taken into account in developing the present invention, permanent state thermal efficiency of the switch being considered the main objective, thereby achieving enormous energy efficiency and energy consumption savings benefits, while at the same time obtaining high electric arc quenching efficiency.

However, with the switch of the invention, two independent circuit breaker mechanisms (or assembly) having different configurations are integrated in one and the same switching device in a very simple manner and in a smaller volume, such that each of them is advantageously connected for only one of the states of the switch, whether the permanent state or the transient state, as follows:

a first circuit breaker mechanism formed by electric breaker elements connected in series is connected in the transient state, which is advantageous for interrupting the electric arc by splitting it into several interruption points, as explained above;

a second circuit breaker mechanism having less electrical resistance than the first circuit breaker mechanism is connected in the permanent or idle period of the switch, short-circuiting the first mechanism, such that all or almost all of the current passes through this second circuit breaker mechanism.

By means of this arrangement of independent configurations, the advantages of the configuration in series for interrupting current are maximized, and energy efficiency is also maximized during the idle state of the switch.

In the switch of the invention, since the switch assemblies are separate assemblies, one for the transient state (5% of the time) for interrupting/establishing switches in series, and another one for the permanent state for normal current flow (95% of the time), it is possible to use different materials for each type of switch assembly and thereby optimize use. Therefore, conductive materials having a higher electrical resistance but better features for withstanding electric arcs, such as hardened steels, stainless steels, nickel-plated steels, etc., can be used for the first switch assembly operating in the transient state without this affecting the performance of the switch, whereas materials which are good electrical conductors, such as copper, aluminum, silver, gold, etc., or even superconducting materials, are used for the contacts of the switch assembly operating in the permanent state.

Furthermore, since the switch assemblies are separate assemblies, one for the transient state and the other one for the permanent state for normal current flow, both switch assemblies can be designed independently in relation to the shape of the contacts and the movements they make, so the functionality of each switch assembly can be maximally optimized.

An additional advantage of the invention is that the desired number of breaker elements can be arranged in series to most efficiently quench the arc, because the number of breaker elements for the transient state does not jeopardize the energy efficiency of the switch in the permanent state.

Therefore, some advantages of the invention are the following:

In the transient state: by optimizing the poles for interrupting current, the size of the switch is reduced, substantially reducing the use of copper, aluminum, silver, gold, etc. which has an enormous environmental impact and therefore reduces the cost of the switch. Interruption conditions can further be improved, even producing a higher interrupting power.

In the permanent state: optimizing the connection of the internal contacts of the switch to increase energy efficiency, achieving better thermal features and lowering the working temperature and in turn energy losses of the switch.

The present invention achieves an enormous improvement of the environmental impact. To get an idea of the impact generated by the present invention, a 2-pole switch from the current state of the art and having similar interruption features has energy losses of 6 W/h due to the configuration in series that has to be formed between its contacts. The estimation that the switch is in service 9 hours a day on average represents an energy loss of 54 W/day, and therefore 19.71 kW/year.

The present invention reduce losses in switches by 66% in the best case according to the theoretical data analyzed (see table below), totally 2 W/h and entailing yearly savings of 13.14 kW/year, which contribute to reducing losses in the transmission of electrical energy, therefore meeting the demanding objectives established by the European Union for the year 2020: reduce energy consumption by 20%, reduce greenhouse gas emissions by 20% and increase the use of renewable energies by 20%.

| | Consumption of a 2-pole switch (W) | Consumption of a 2-pole switch (Kw/year) | Consumption of 30,000 switches sold (Kw/year) | Equivalent in tons of $CO_2$ |
|---|---|---|---|---|
| Known switch | 6 | 19.71 | 591.300 | 251.07 |
| Switch of the invention | 2 | 6.57 | 197.100 | 83.69 |
| Loss reduction | 4 | 13.14 | 394.200 | 167.38 |
| % savings | 66% | 66% | 66% | 66% |

DESCRIPTION OF THE DRAWINGS

To complement the description being made and for the purpose of helping to better understand the features of the invention according to a preferred practical embodiment thereof a set of drawings is attached as an integral part of said description where the following is depicted with an illustrative and non-limiting character:

FIG. 1B shows multiple breaker elements.

FIG. 2A is a schematic depiction and FIG. 2B is an electrical diagram.

FIG. 3A shows the switch in an open state, FIG. 3B shows the switch in a state in which the breaker elements of the first switch assembly are closed and the second switch assembly is open, and FIG. 3C shows the switch in a state in which the breaker elements of both the first and the second switch assembly are closed, so the current would flow through the second switch assembly.

FIG. 4A shows an outer view of the switch with the complete casing, and FIG. 4B shows the switch with part of the casing removed to show most of the internal components of the switch.

FIG. 6A is a side elevational view of the first and the second rotor from a 0° position with one of the parts of the rotor removed; FIG. 6B is a section view along plane F-F in FIG. 6A; FIG. 6C is the same section view as FIG. 6B but with both parts of the rotor; FIG. 6D is an enlarged detail of FIG. 6A; FIG. 6E is a perspective view; and FIG. 6F is an enlarged detail taken of FIG. 6E.

FIG. 7C is an enlarged detail of FIG. 7A, FIG. 7D is a perspective view; and FIG. 7E is an enlarged detail taken of FIG. 7D.

FIG. 8C is an enlarged detail of FIG. 8A, FIG. 8D is a perspective view; and FIG. 8E is an enlarged detail taken of FIG. 7D.

FIG. 9 C is a sectional view of F-F. FIG. 9D is an enlarged detail of FIG. 9A, FIG. 9E is a perspective view; and FIG. 9F is an enlarged detail taken of FIG. 9E.

FIGS. 10A-10D show several views of the embodiment of FIG. 5 corresponding to a 0° rotational position of the rotors with respect to a horizontal plane (P), where FIG. 10A is a side elevational view, FIG. 10B is a front elevational view and FIG. 10C is a perspective view. Many of the components of the switch have been omitted in the figures to more clearly show the moving parts thereof. FIG. 10D is a perspective view of the moving contacts.

FIG. 11A is a side elevational view. FIG. 11C is a perspective view. The arrows indicate the path of the electric current.

FIG. 12A is a side elevational view. FIGS. 12B and 12C are a front elevational view. FIGS. 12D and 12E are perspective views from different angles.

FIG. 13A is a side elevational view. FIGS. 13B and 13C are a front elevational view. FIGS. 13D and 13E are perspective views from different angles.

FIG. 14A is a side elevational view. FIGS. 14B and 14C are a front elevational view. FIG. 14D is a perspective view. FIGS. 14E and 14F are an enlarged detail taken of FIG. 14B.

FIG. 15A is a perspective explosion view. FIG. 15B is a front elevational explosion view. FIG. 15C is a side elevational explosion view.

FIG. 16A is a front elevational view. FIG. 16B is a front elevational view. FIG. 16C is a perspective view. FIG. 16D is an enlarged detail taken of FIG. 16A. FIG. 16C is a perspective view. FIG. 16E is an enlarged detail taken of FIG. 16C.

FIG. 17A is a front elevational view. FIG. 17B is a side elevational view. FIG. 15C is a perspective view.

FIG. 18A is a front elevational view. FIG. 18B is a side elevational view. FIG. 18C is a perspective view.

PREFERRED EMBODIMENT OF THE INVENTION

Figure 1A:
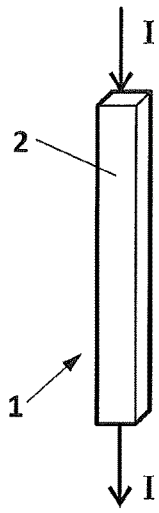
FIGS. 1A and 1B schematically show the conventional technique of splitting the electric current at several interruption points to make quenching electric arcs easier, where Figure A shows a single breaker element
Figure 1B:
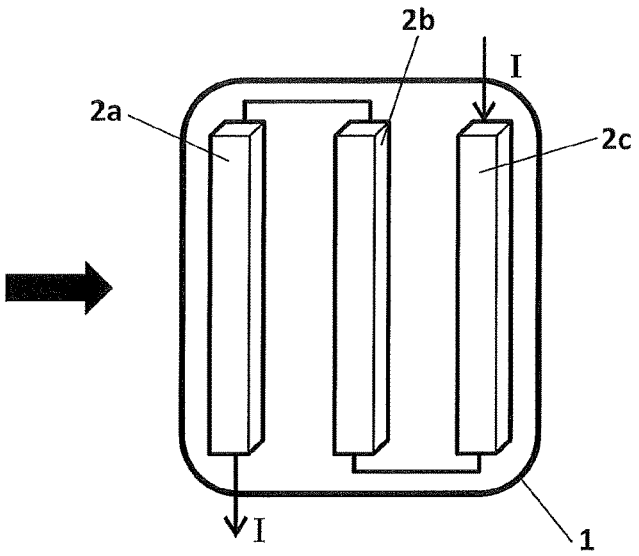
Figure 2A:
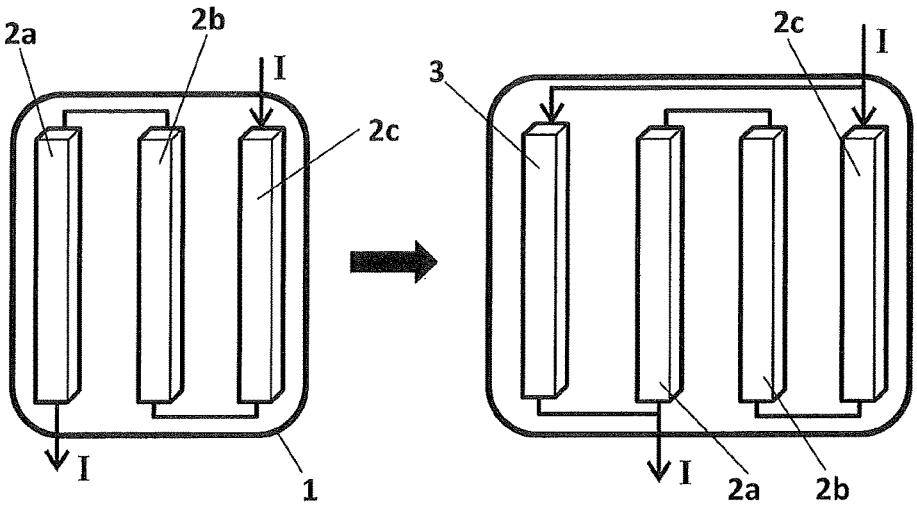
FIGS. 2A and 2B show the method for interrupting and connecting current according to the present invention, where

FIG. 2 generically illustrates the method and switching device of the present invention, where it can be seen that according to the present invention, the traditional connection of breaker elements (2*a*, 2*b*, 2*c*) connected in series shown in FIGS. 1B and 2A is complemented with a delayed breaker element (3) connected in parallel to the complete series of the three breaker elements (2*a*, 2*b*, 2*c*) connected in series. Furthermore, the invention envisages that the switching device is configured such that closing (the electrical connection) of the delayed breaker element (3), as indicated by its denomination, is delayed in time with respect to the closing of the three breaker elements (2*a*, 2*b*, 2*c*) which is simultaneous.

Figure 2B:
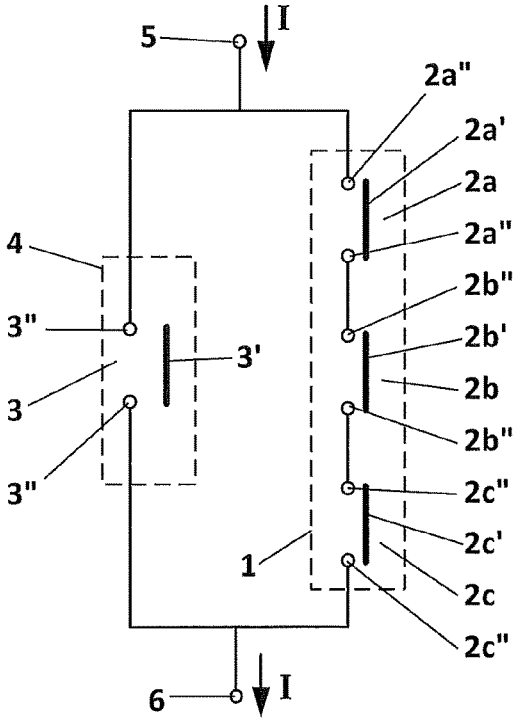

FIG. 2B illustrates the invention by means of an electrical diagram, where it can be seen that a first switch assembly (1) comprises three electric breaker elements (2*a*, 2*b*, 2*c*) connected in series to one another and between a first and second connection terminal (5, 6), and a second switch assembly (4) comprises a single electric breaker element (3) connected between the first and the second connection terminal (5, 6) and in parallel to the first switch assembly (1), i.e., with the chain of breaker elements (2*a*, 2*b*, 2*c*) connected in series.

Each of the breaker elements (2*a*, 2*b*, 2*c*, 3) of the switching device is formed by two fixed contacts (2*a*", 2*b*", 2*c*", 3") interconnected with the remaining fixed contacts as seen in the drawing, and a moving contact (2*a*", 2*b*", 2*c*", 3") that can be connected to and disconnected from its respective fixed contacts.

All the moving contacts (2*a*", 2*b*", 2*c*", 3") are mounted in one and the same body called moving actuator (not depicted in FIG. 2B). Therefore, in a switch closing operation in which the switch goes from being open, preventing current flow (I), to being closed to allow current flow (I) through the terminals (5, 6), first the three breaker elements (2*a*, 2*b*, 2*c*) close and the delayed breaker element (3) is kept open, and after a transient time period has elapsed, in which the electric arcs generated in the three interruption points (2*a*, 2*b*, 2*c*) have already been quenched, the delayed breaker element (3) closes, so in that instant current (I) flows only through the delayed breaker element (3) because that branch of the circuit has less electrical resistance than the branch in which the three breaker elements (2*a*, 2*b*, 2*c*) are located as it has fewer breaker elements in series between the terminals (5, 6). The switching device stays in said permanent state for conduction the time necessary until the following opening operation is required. The switch can be configured so that the three breaker elements (2*a*, 2*b*, 2*c*) open or stay closed during said permanent state.

Any technique or means can be used to obtain delayed connection of the delayed breaker element (3) with respect to the three breaker elements (2*a*, 2*b*, 2*c*), which will also depend on each type of switch in which the invention is implemented. Said delay is preferably achieved by making the maximum gap between the moving contact (3") and the fixed contacts (3") of the delayed breaker element (3) larger than the gap between each moving contact (2*a*", 2*b*", 2*c*") of the breaker elements (2*a*, 2*b*, 2*c*) and its respective fixed contacts (2*a*", 2*b*", 2*c*", 3"), as illustrated in FIG. 2B. To that end, said fixed and moving contacts (3", 3") are suitably sized and positioned to obtain said functionality.

FIG. 2 also illustrates the method of the invention for interrupting and allowing the flow of an electric current (I) by means of a switching device, preferably a switch having helicoidal, linear or rotational movement on one and the same plane. The method comprises providing the switching device with a first switch assembly (1) provided with two or more electric breaker elements (2*a*, 2*b*, 2*c*) connected in series between a first and a second connection terminal (5, 6), and a second switch assembly (4) connected in parallel to the first switch assembly (1), and making the electrical resistance of the second switch assembly (4) between the terminals (5, 6) less than that of the first switch assembly (1), preferably making the second switch assembly (4) have a smaller number of breaker elements connected in series between the terminals (5, 6) than the first switch assembly.

For the switch closing operation, the method comprises first closing the first switch assembly (1) and keeping the second switch assembly (4) open, and after an established time period after the first switch assembly (1) closes, closing the second switch assembly (4) such that the current (I) then flows through the second switch assembly (4).

Furthermore, the method of the invention comprises actuating the first and the second switch assembly by means of one and the same operating element, specifically by means of a moving actuator common to both switch assemblies. Therefore, successive connection of the first and the second switch assembly is obtained in the same operation, i.e., with a single movement, so both switch assemblies can be operated in a manner conventional with one and the same mechanism external to the device.

The moving contacts of the first and the second switch assembly move at the same time, however the invention enables the type of movement to be different for each switch assembly. Therefore, in a preferred embodiment the method of the invention comprises moving the moving contacts of the first and the second switch assembly simultaneously with a linear movement component along an axis (X). In another preferred embodiment, the method of the invention comprises moving the moving contact (3") rotationally on one and the same plane and about an axis (X), whereas the moving contacts of the first switch assembly simultaneously move helically with respect to an axis (X), or alternatively in another preferred embodiment of the invention, the moving contacts of the first and the second switch assembly move simultaneously by rotating them with respect to an axis (X) but without moving forward along the axis.

Figure 3A:
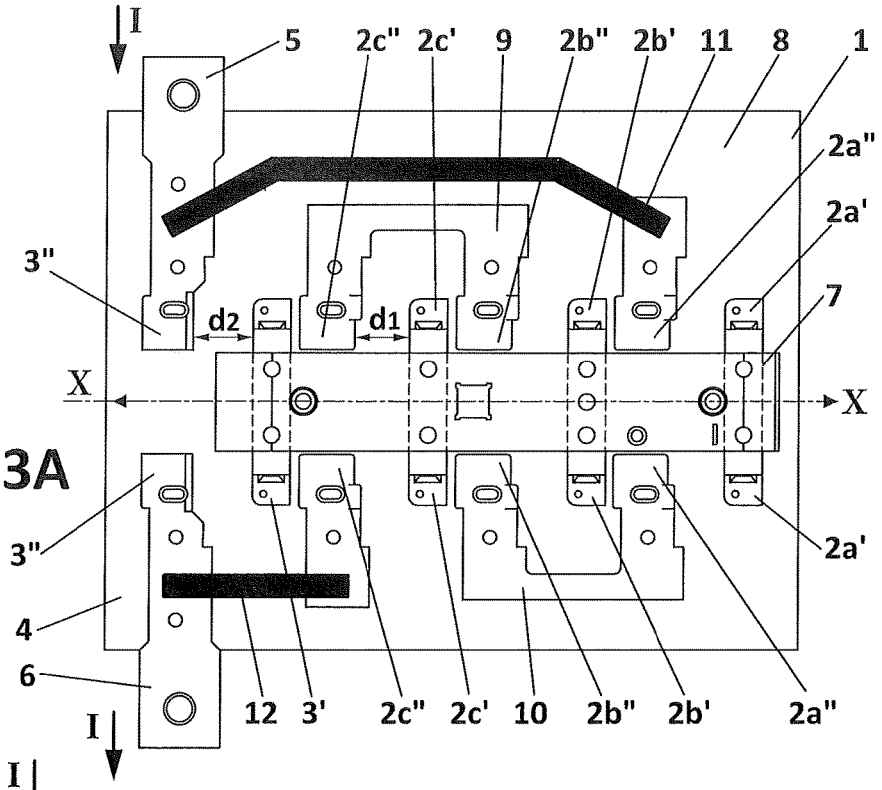
FIGS. 3A-3C show several plan views of a preferred embodiment of the invention consisting of a linear switch, where
Figure 3B:
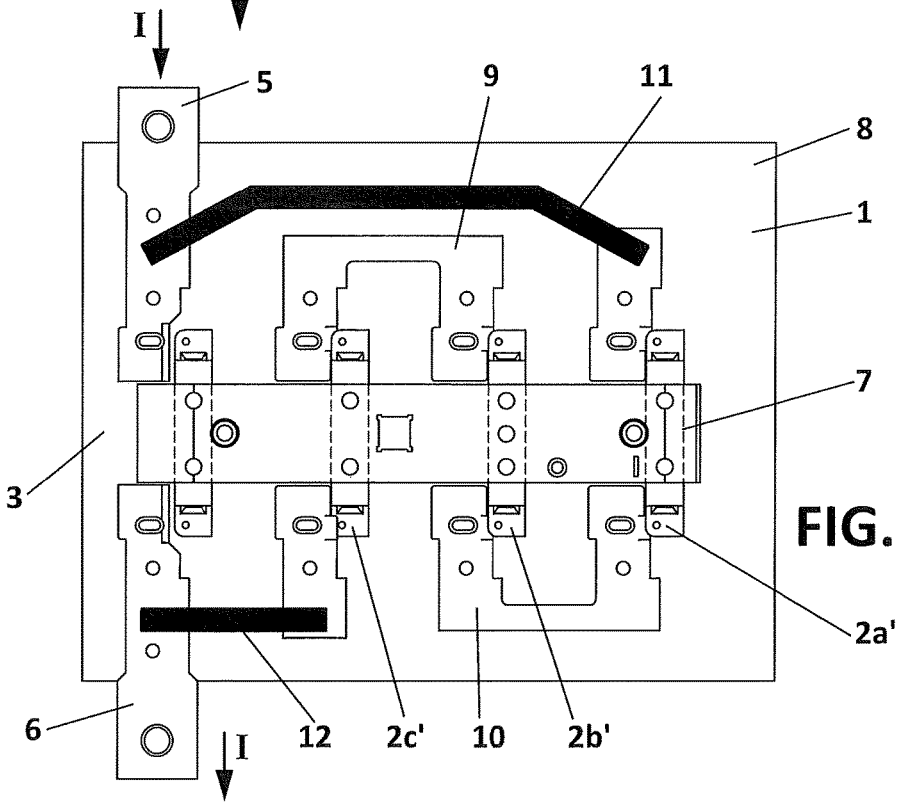
Figure 3C:
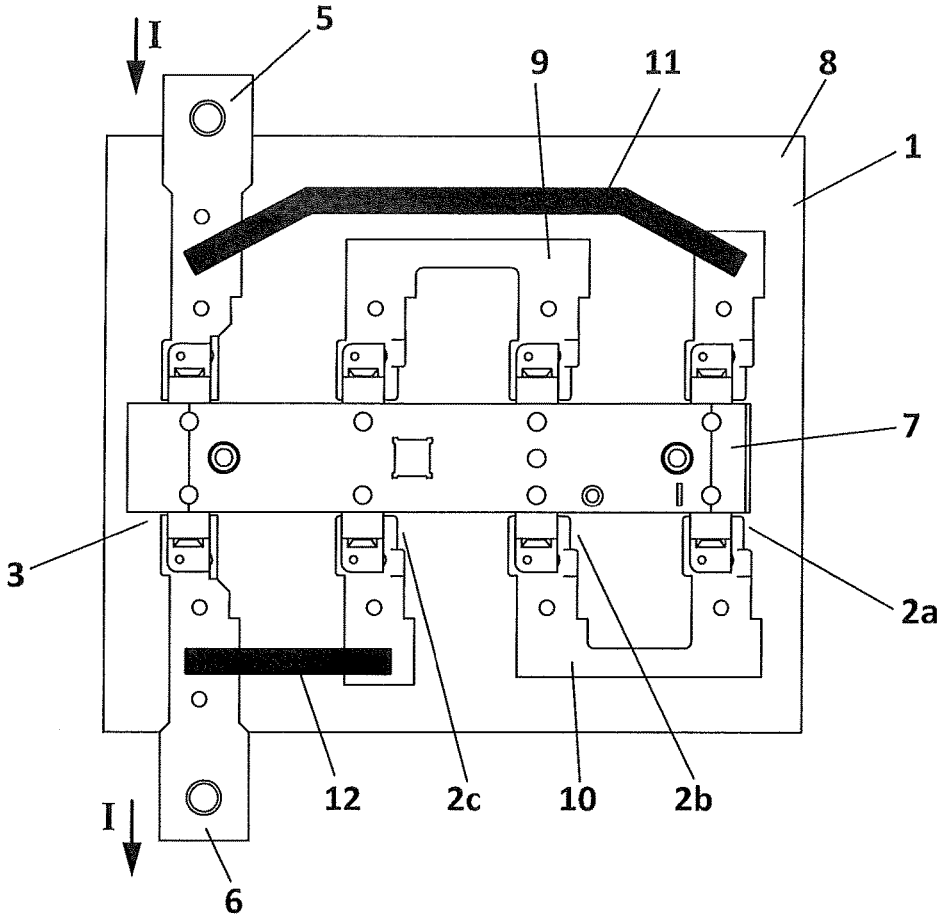

FIG. 3 shows an embodiment of the switch of the invention, specifically a linear switch, comprising a moving actuator made of insulating material, which in this case consists of an elongated slide (7), which is arranged along the direction of an axis (X), and is configured and mounted in a casing (8) made of insulating material of the switch such that it is linearly movable back and forth along said axis (X), between the end position of FIG. 3A and the end position of FIG. 3C.

Each moving contact (2*a*", 2*b*", 2*c*") of the first and the second switch assembly (1, 4), is mounted in the slide (7)

transverse to said axis (X), and such that a first end of the moving contacts projects from a first side face of the slide, and a second end of the moving contacts projects from a second side face of the slide opposite the first face. Preferably, all the moving contacts (2*a*", 2*b*", 2*c*") have the same shape and size, and consist of a straight elongated metal plate.

The fixed contacts (2*a*", 2*b*", 2*c*", 3") are mounted in a fixed position of the casing (8) of the switch and arranged in pairs opposite one another on different sides of the slide (7) and arranged for being contacted by the respective moving contact (2*a*", 2*b*", 2*c*", 3"). The moving contacts (2*a*", 2*b*", 2*c*") and their respective fixed contacts (2*a*", 2*b*", 2*c*", 3") are configured and positioned such that they come into contact but in a sliding manner, i.e., they contact one another at the same time that they slide as the slide moves. The slide (7) is arranged between the fixed contacts.

It can be seen in FIG. 3 how the three electric breaker elements (2*a*, 2*b*, 2*c*) of the first assembly and switch (1) are connected in series to one another through connections or jumpers (9, 10), between a first and second connection terminal (5, 6) by means of respective connection lines (11, 12), and on the other hand the second switch assembly (4) comprises a single electric breaker element (3) connected between the first and the second connection terminal (5, 6) and in parallel to the chain of breaker elements (2*a*, 2*b*, 2*c*) connected in series. The connection terminals (5, 6) are arranged opposite one another, and the electric breaker element (3) is mounted on one end of the slide (7) for contacting directly with the connection terminals (5, 6).

The movement of the slide (7) in a switch closing operation follows the sequence of FIGS. 3A, 3B and 3C. In the first end position of the slide of FIG. 3A, all the breaker elements (2*a*, 2*b*, 2*c*,3) are open, so there is no current flow. As the slide (7) moves forward along the axis X towards the left side of the drawing, it reaches an intermediate position in which the moving contacts (2*a*", 2*b*", 2*c*") are connected with their respective fixed contacts (2*a*", 2*b*", 2*c*"), and current flow through the terminals (5, 6) is therefore allowed by means of the breaker elements (2*a*, 2*b*, 2*c*). In this position, it can be observed that the delayed breaker element (3) is open, since the moving contact (3") has still not contacted its respective fixed contacts (3"), in this case the ends of the terminals (5, 6).

It can now be seen more clearly in this embodiment that said delay in closing the delayed contact (3) is achieved by suitably placing the fixed and moving contacts with respect to one another to make the maximum gap (d2) that the moving contact (3") of the second switch assembly must travel until contacting with its fixed contacts (3") is greater than the maximum gap (d1) that each moving contact (2*a*", 2*b*", 2*c*") of the first switch assembly (1) must travel until contacting with their respective fixed contacts (2*a*", 2*b*", 2*c*").

In other words, the path or time from the furthest or maximum point that the moving contact of the second switch assembly must travel until contacting with its fixed contacts is longer than the path (from the furthest or maximum point) that the moving contacts of the first switch assembly must travel until contacting with their fixed contacts, such that in the electrical closing operation the second switch assembly closes after the first switch assembly closes.

In other embodiments of the invention, the delay in closing the delayed contact (3) can be obtained by changing the position and/or shape of the moving contact of the second switch assembly.

Finally, in the position of FIG. 3C the slide reaches its second maximum end position in which all the breaker elements (2*a*, 2*b*, 2*c*, 3) are closed, so all or most of the current (I) passes directly through the delayed breaker element (3).

In the switch opening operation, the movement of the slide and the connections are opposite those described above, i.e., with a sequence of movements from the position of FIG. 3C to that of FIG. 3A. In FIG. 3A all the breaker elements are closed, and as the slide (7) moves towards the right side in the drawing, first the delayed breaker element (3) opens but the breaker elements (2*a*, 2*b*, 2*c*) stay closed so the current flows through these three breaker elements connected in series, and an instant after that the three breaker elements (2*a*, 2*b*, 2*c*) open as shown in FIG. 3A, so current (I) is open simultaneously at three points different, thereby reducing the magnitude of the electric arc and making it easier to quench it.

FIGS. 4 to 14 show another preferred embodiment of the invention, consisting of a rotary switch, more specifically a helicoidal switch in which the moving component of the switch, i.e., the actuator, moves defining a helicoidal path. In such helicoidal switch, a second simultaneous movement component is added to the linear movement component on an axis X of the preceding embodiment, the former consisting of a rotation about that same axis X.

Figure 4A:
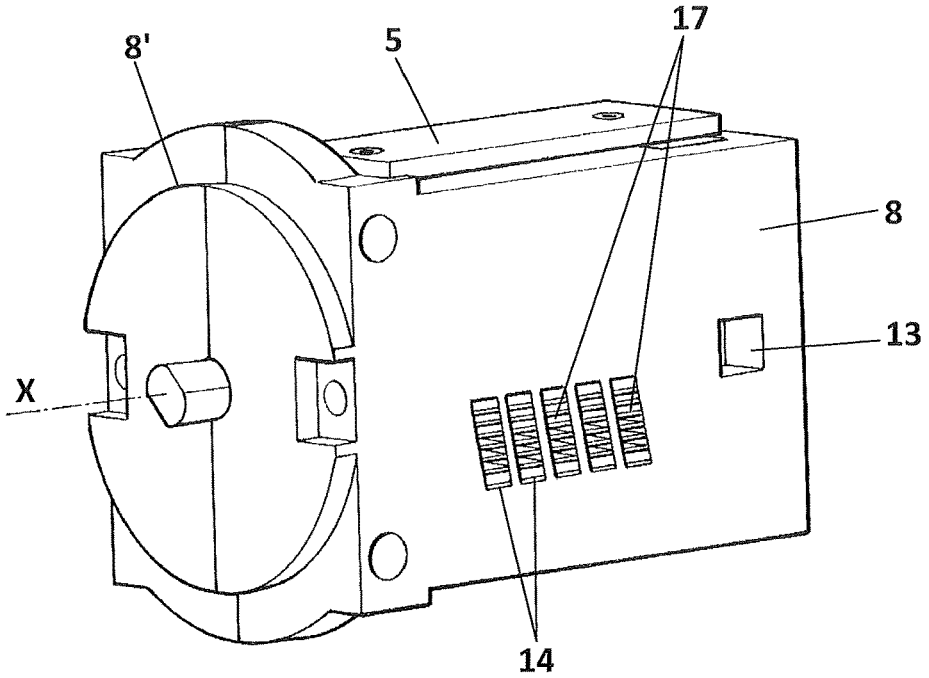
FIGS. 4A and 4B show two perspective depictions of a helicoidal switch according to one embodiment of the invention, where
Figure 4B:
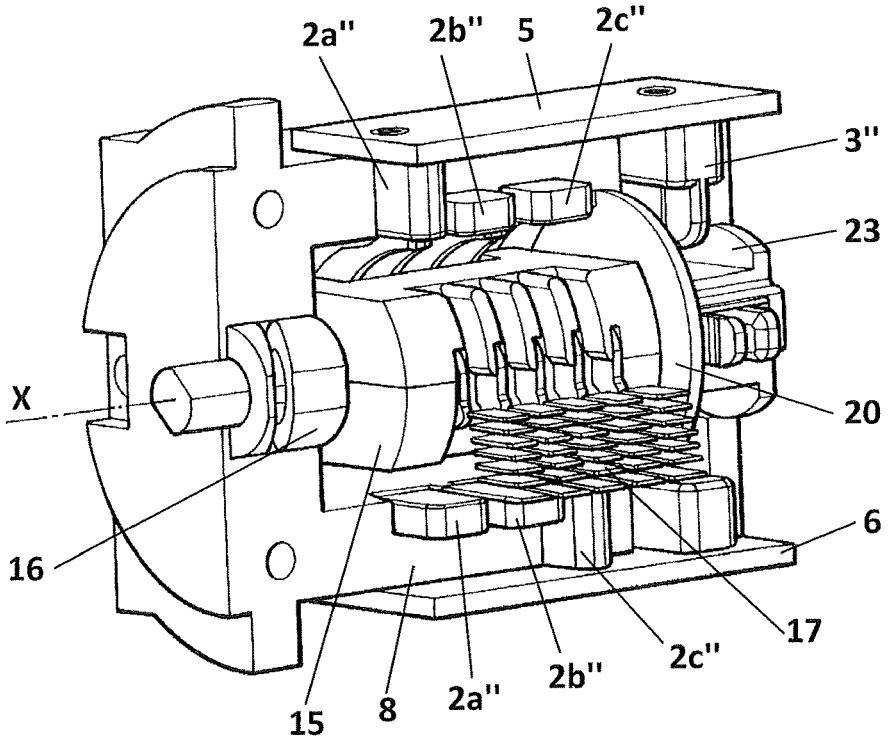
Figure 5A:
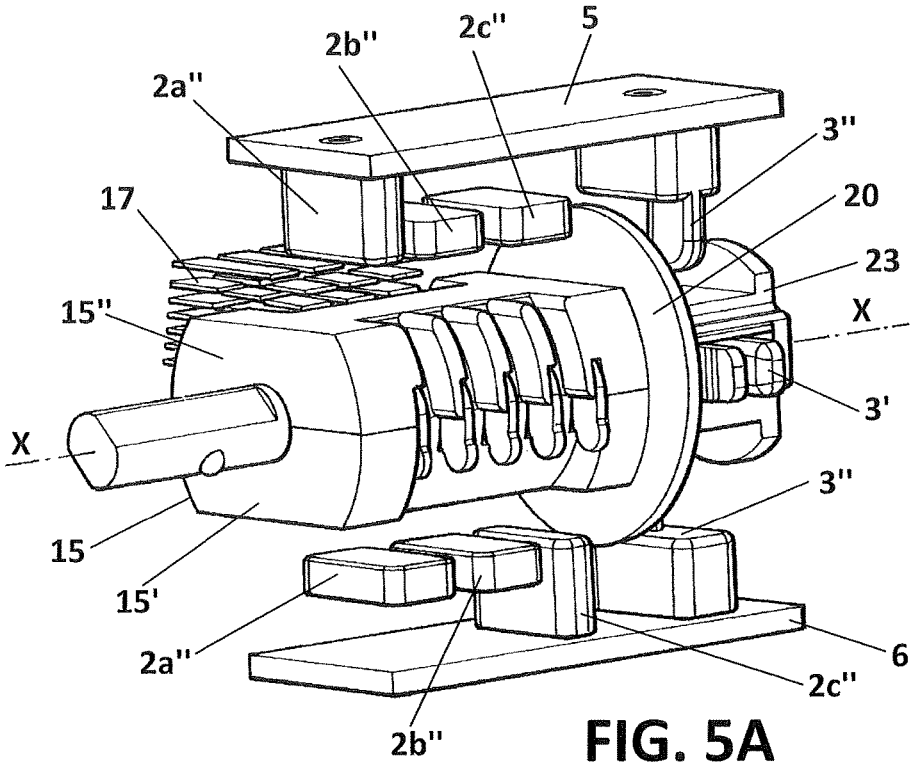
FIGS. 5A and 5B show two other additional perspective views of the switch of FIG. 4, where in FIG. 5A the casing has been removed, and in FIG. 5B the rotor has been removed to better show the internal elements.
Figure 5B:
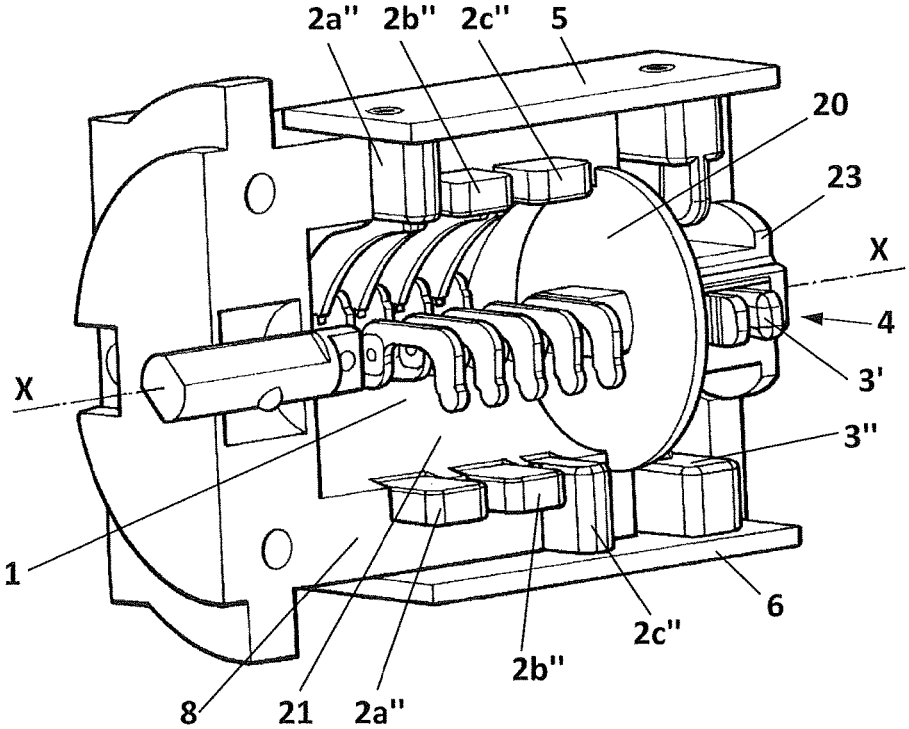

FIG. 4A shows a switch of this embodiment, including an outer casing made of insulating material formed by two parts (8, 8') coupled to one another, having at least one ventilation through hole (13) and at least gas exhaust windows (14), both communicated with the inside of the switch.

In this embodiment, the actuator is formed by two parts, a first rotor (15) and a second rotor (23) both coupled to one another and simultaneously movable, but with different movements as will be described below. The moving contacts of the first switch assembly are mounted in the first rotor (15), and the moving contact of the second switch assembly is mounted in the second rotor (23).

The first rotor (15) is an elongated body placed longitudinally in the direction of the axis X, and is preferably formed by two parts (15', 15") coupled to one another. The first rotor (15) is mounted inside the casing (8, 8') such that it is able to slide over an inner surface thereof and move in a helicoidal manner with respect to said axis X, i.e., the switch has means for making the rotor (15) move with a linear movement component with respect to the axis X and simultaneously with a rotational movement component with respect to the same axis X.

The second rotor (23) is in the form of a reel and is mounted coaxially to the first rotor (15) with respect to the axis X, and is likewise mounted inside the casing (8, 8') such that it is able to slide over an inner surface thereof. Unlike the first rotor (15), this second rotor (23) is configured together with the casing such that the linear forward movement on the axis X is prevented, i.e., it can only rotate about the axis (X), staying in one and the same plane without moving forward along the axis.

The first and the second rotor (15, 23) are coupled to one another such that each one can perform the movements described above, and such that the first and the second rotor are integral in the rotational movement, i.e., they rotate at the same time about the axis (X), however the first rotor (15) can move forwards and backwards longitudinally on the axis (X), whereas axial movement of the second rotor (23) is prevented. This coupling between both rotors and the relative movement between both is illustrated in FIGS. 6 to 9 when the rotors rotate clockwise when performing an electrical switch closing operation, understanding that the rotors rotate in the opposite direction to perform an opening operation, and therefore the movements of the first and the second rotor (15, 23) are back and forth between a switch closed position and electrical interruption position.

Figures 6A, 6B, 6C, 6D:
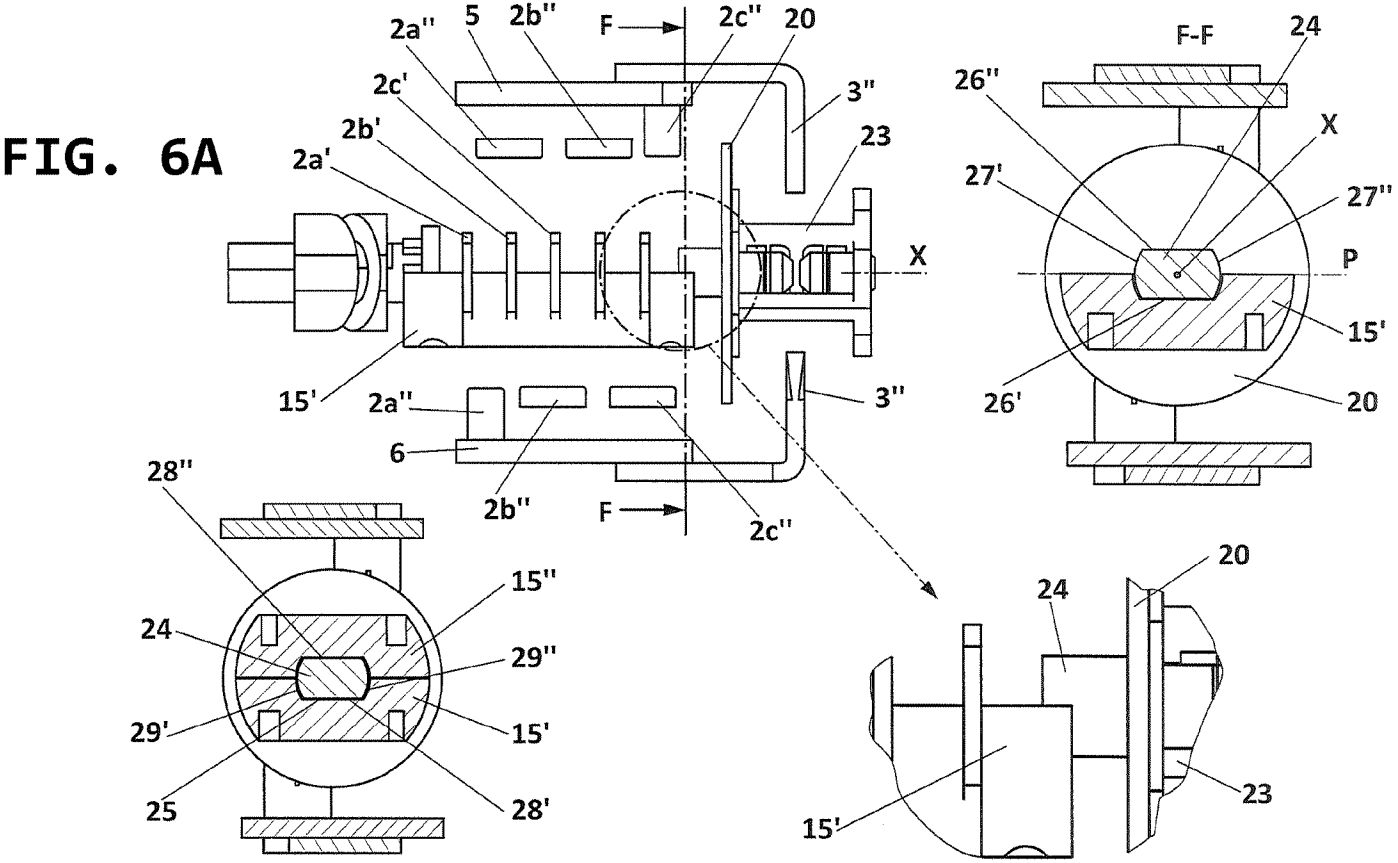
FIGS. 6A-6F show several views of the embodiment of FIGS. 4 and 5 to illustrate the coupling and relative movement between the first rotor and the second rotor, where
Figures 6E, 6F:
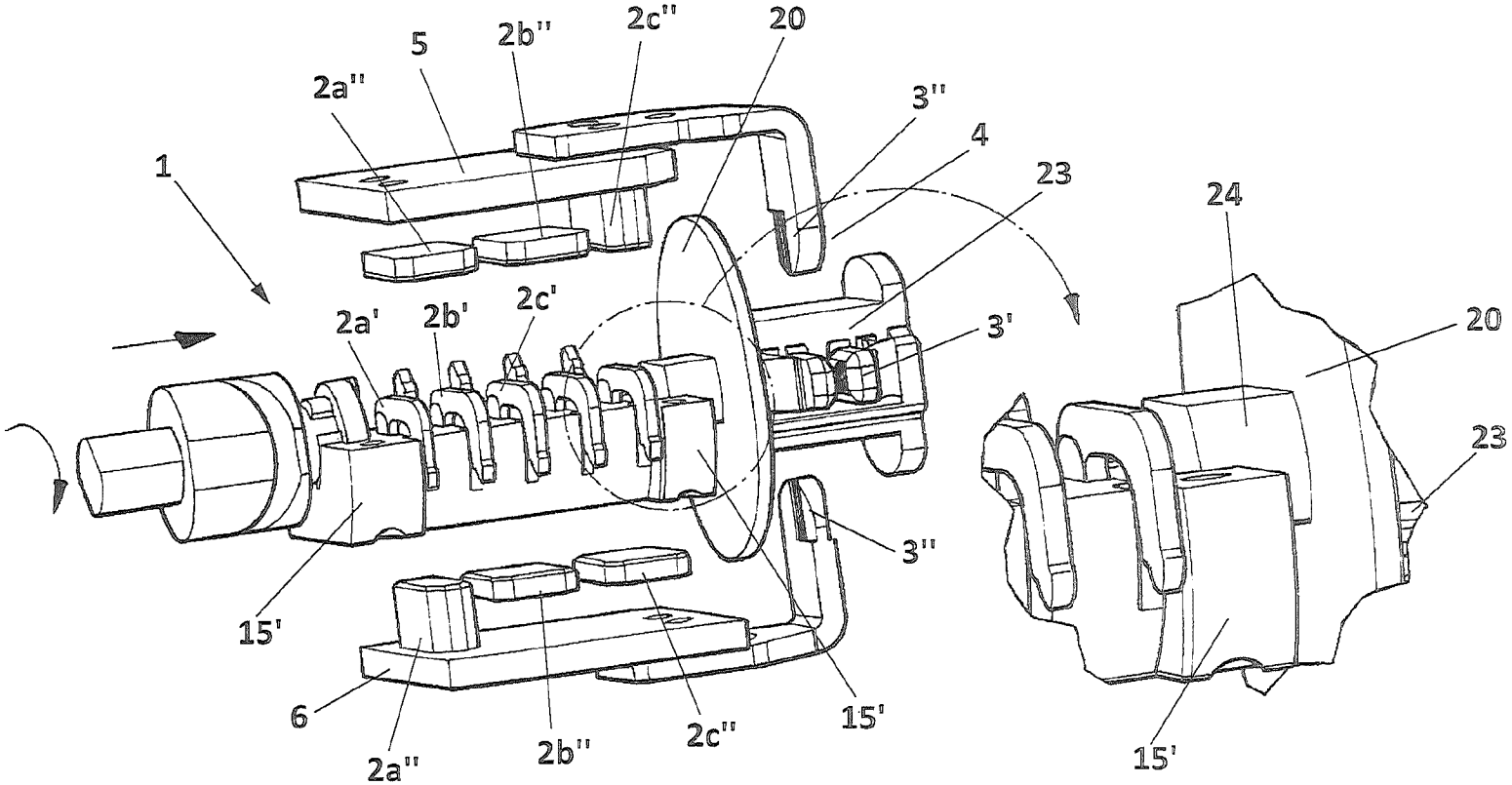
Figure 7B:
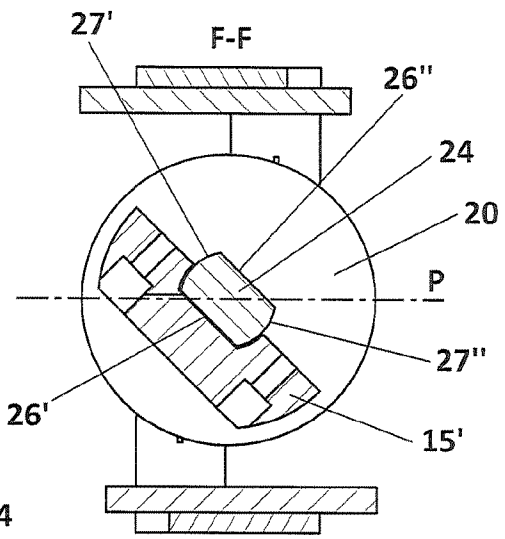
FIGS. 7A-7E show a depiction similar to that of FIG. 6 with the same views, but corresponding to a position in which the first and the second rotor have rotated 45° clockwise with respect to plane P seen in FIG. 7B.
Figure 7A:
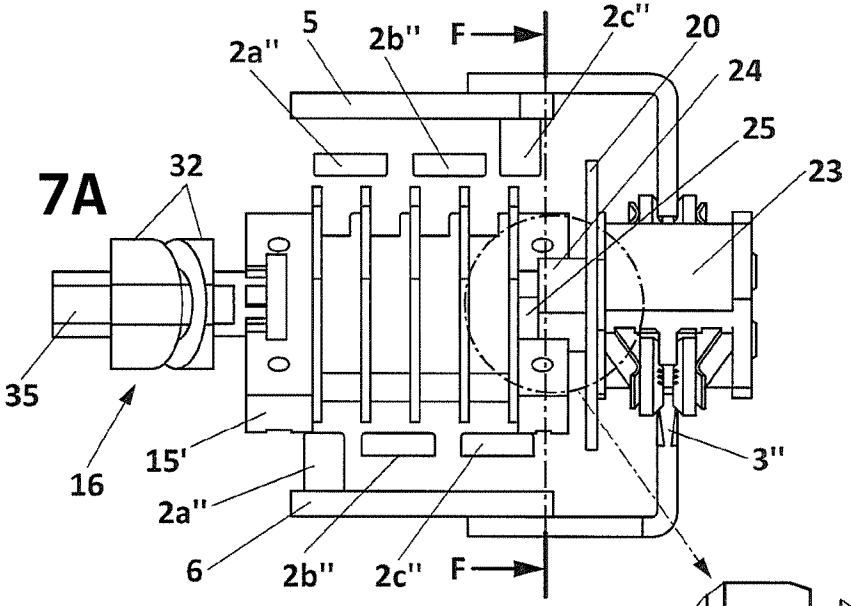
Figure 7C:
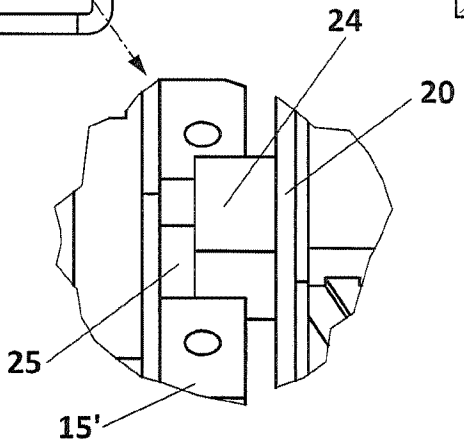
Figure 7E:
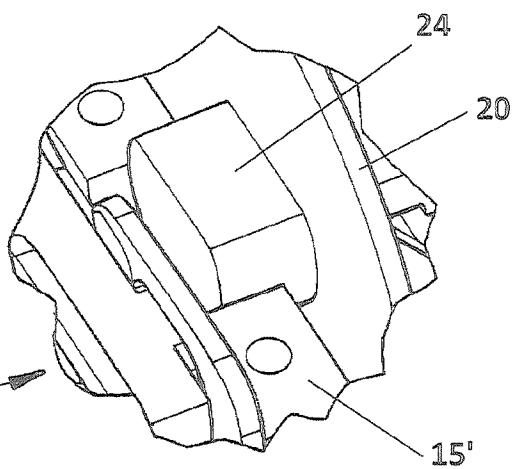
Figure 7D:
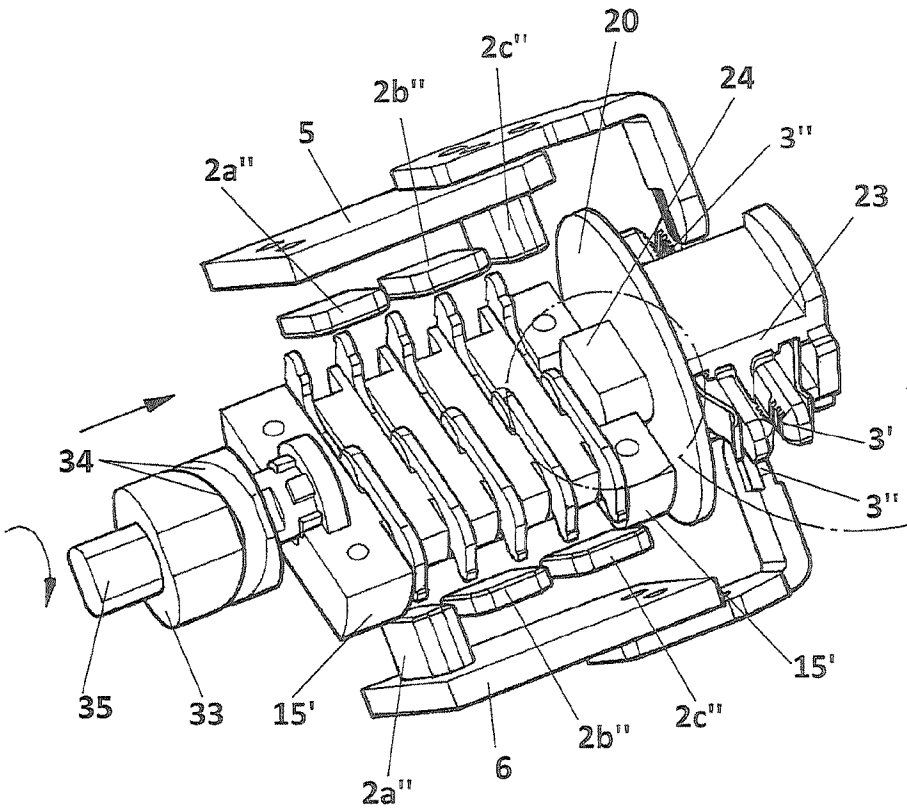
Figure 8B:
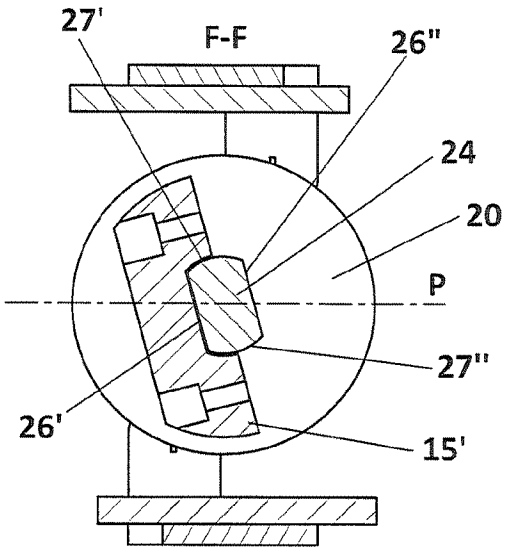
FIGS. 8A-8E show a depiction similar to that of FIG. 7 but corresponding to a position in which the first and the second rotor have rotated 70° clockwise with respect to plane P seen in FIG. 8B.
Figure 8A:
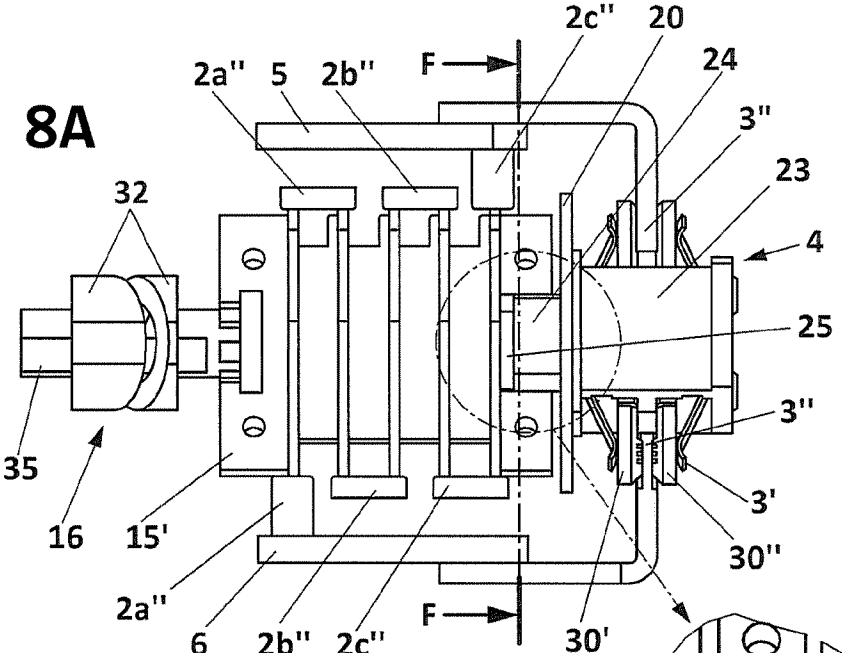
Figure 8C:
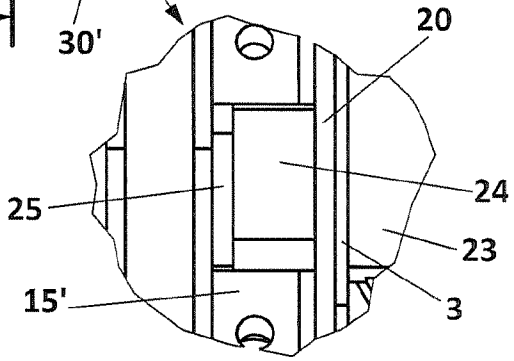
Figures 8D, 8E:
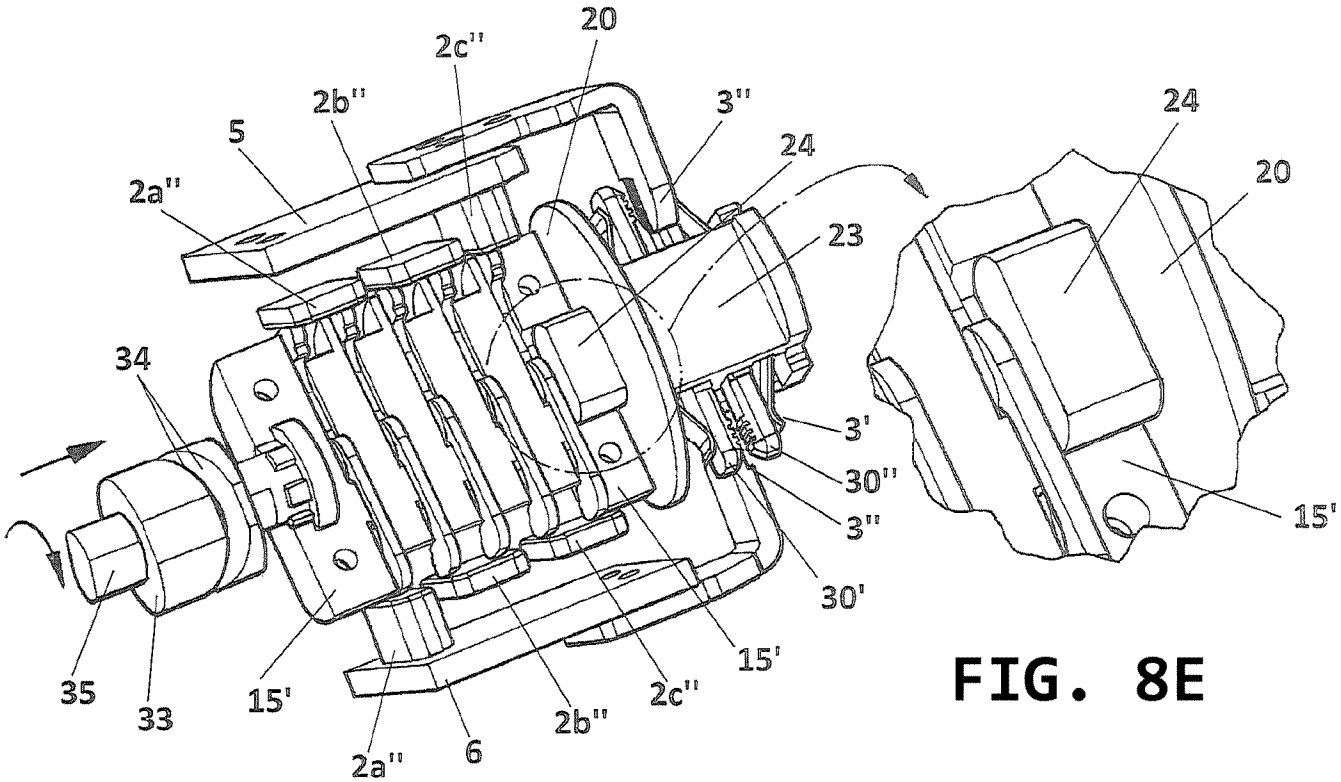

The coupling between the first and the second rotor (15, 23) is a male-female coupling and is formed by a cavity (25) existing in the first rotor (15) and a prolongation (24) projecting from the second rotor (23) and introduced in said cavity (25), where the cavity and the prolongation are arranged axially on the axis (X) and have a matching shape, as is more clearly seen in FIG. 6C. Specifically that shape of the prolongation consists of two planar surfaces (26', 26") parallel to one another and two convex-curved surfaces (27', 27") facing one another and having the same curvature. In turn, the cavity (25) is formed by two planar surfaces parallel to one another (28', 28") on which the surfaces (26', 26") axially slide, and two curved surfaces (29', 29") facing one another and having the same curvature, and on which the surfaces (27', 27") axially slide. Rotation of the first rotor (15) is therefore transmitted to the second rotor (23) and they both rotate at the same time due to the mutual contact of the superimposed planar surfaces, while at the same time the first rotor (15) moves longitudinally on the axis (X), and the second rotor (23) stays in a fixed axial position.

Figures 9A, 9B, 9C, 9D:
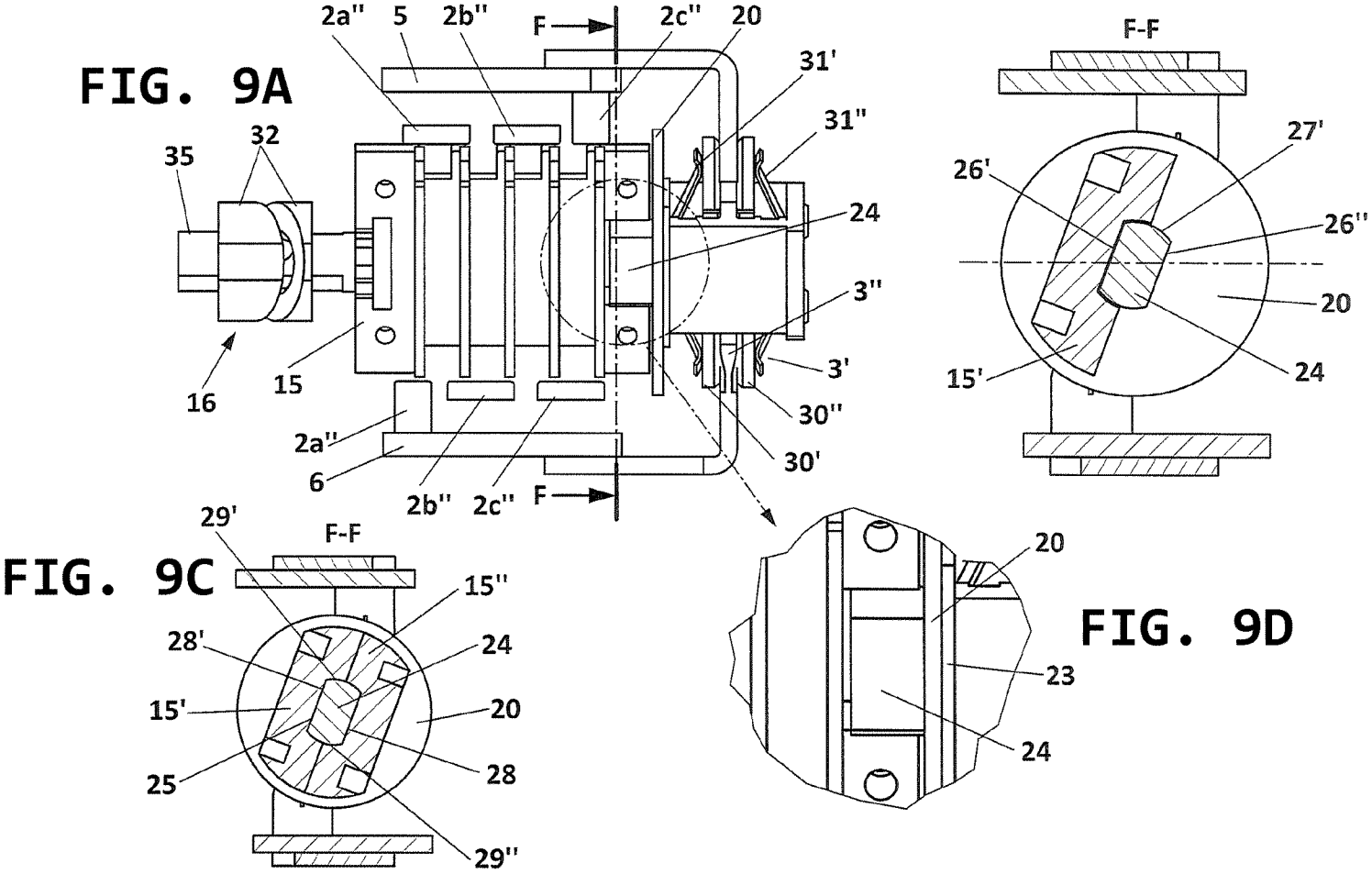
FIGS. 9A-9F show a depiction similar to that of FIG. 7 but corresponding to a position in which the first and the second rotor have rotated 105° clockwise with respect to plane P seen in FIG. 9B.
Figures 9E, 9F:
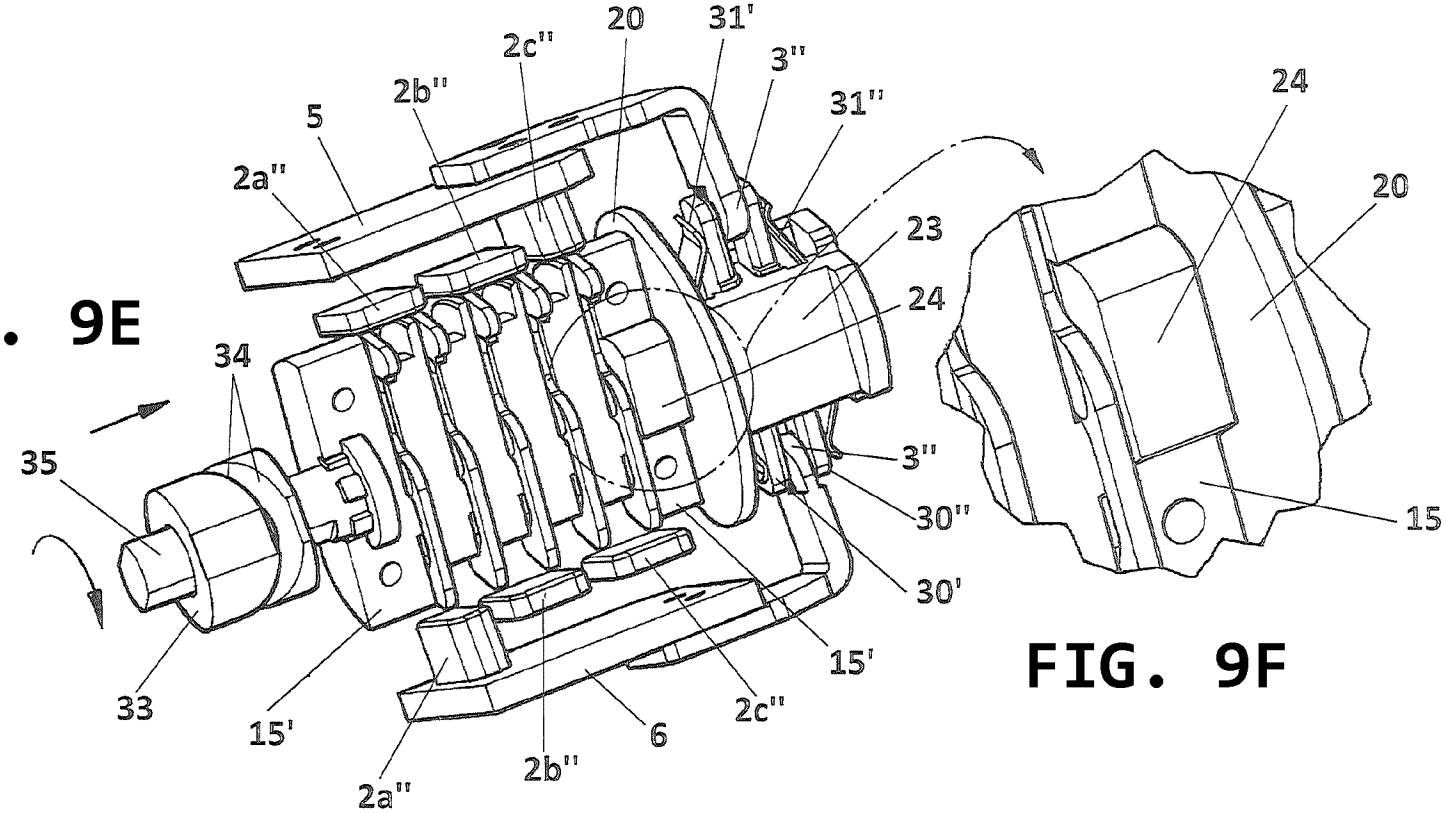

It can be seen in the sequence of FIGS. 6 to 9 how as the first and the second rotor (15, 23) rotate together due to the helicoidal movement of the first rotor (15), the prolongation (24) is inserted further each time into the cavity (25) until reaching the maximum coupling position shown in FIGS. 9D and 9F.

Such coupling between both rotors on one hand enables the first and the second switch assembly (1, 4) to be operable at the same time by means of the same operating mechanism, and on the other hand, since both the first and the second switch assembly (1, 4) have different functionalities, it enables being able to optimize the design of their contacts for the specific function they have to perform. In that sense, it can be observed that the moving contacts (2*a*", 2*b*", 2*c*") of the first switch assembly (1) are a thin metal plate since the contact surface with the respective fixed contacts should be very small to make it easier to quench arcs.

On the other hand, the moving contact (3") of the second switch assembly (4) is formed by two planar metal plates (30", 30") superimposed in a matching position which are mounted in the second rotor (23), such that the ends of these plates project from the rotor forming respective clamps at each end used for gripping by applying pressure on the respective fixed contacts (3", 3") of the second switch assembly. This configuration of the second switch assembly (4) is optimal for functionality because in the current conduction permanent state, there should be maximum contact surface between the terminals to make current flow easier.

For the same purpose, there is a pair of strips (31", 31") mounted in the second rotor (23) and placed to apply pressure (due to their elastic property) respectively on the ends of respective metal plates (30", 30") against the fixed contacts (3", 3") and thereby assure proper contact between both elements at all times.

In this embodiment a disc-shaped wall (20) made from an insulating material, preferably forming an integral part of the second rotor (23) and configured such that it defines inside the casing (8) and on each of its sides respective chambers insulated from one another by the wall (20) so that the first and the second switch assembly (1, 4) are housed respectively in said chambers (21, 22), is arranged, thereby preventing the electric arc from being able to hop from one switch assembly to the other since they are separated by the wall (20).

The aforementioned means for obtaining helicoidal movement of the first rotor (15) can be obtained by configuring the rotor and the stator as if they were a screw and a nut, respectively, coupled by means of threading. Alternatively, the means for the helicoidal movement can be obtained by means of an external actuation mechanism (16) coupled to the rotor and configured to produce said helicoidal movement.

Another aspect of the invention relates to an actuation mechanism (16) for converting rotational movement into helicoidal movement to produce the helicoidal movement of the first rotor (15). Said mechanism (16) is formed by a fixed body (32) having a through cavity (33) extending along an axis (X), and said body provided with two guide surfaces (34) parallel to one another and arranged in an inclined manner with respect to said axis (X), said guide surfaces (34) being arranged around said through cavity (33). A moving rod (35) is movably housed inside said through cavity, the moving rod being provided with a lug (36) projecting in the radial direction with respect to an axial axis of the rod, where said lug is arranged tightly between said guide surfaces, such that it can slide on them, contacting with both surfaces. That mechanism (16) is also mounted in the casing (8, 8") and during use it is operated by means of another conventional external mechanism (not depicted) for actuating such switches, which applies a rotation torque on the rod (35) which is transformed into helicoidal movement by the mechanism (16).

On the other hand, the switch incorporates a group of deionizing plates (17) placed close to the fixed and moving contacts and close to the gas exhaust windows (14) of the casing.

Figure 10B:
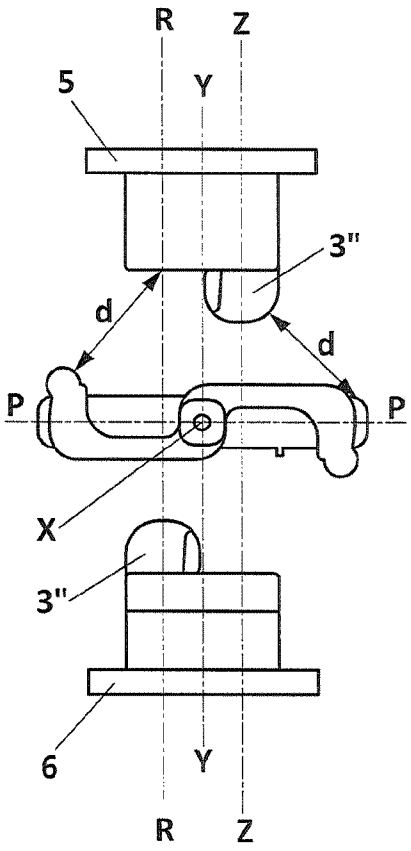

The moving contacts (2*a*", 2*b*", 2*c*") of the first switch assembly (1) are mounted in the rotor (15) and are therefore moved by the rotor as well following a helicoidal path. Preferably, as shown in FIG. 10 the moving contacts of the first switch assembly have the same shape, are mounted in the rotor equidistantly from one another, and are placed in the same angular position with respect to the axis X (i.e., their contour or perimeter coincide in a view along the axis X of FIG. 10B), as particularly observed in FIG. 10B. The moving contact (3") of the delayed breaker element (3) has a different shape from the previous ones, but is placed in the same angular position, or in other words, it is placed on the same plane P as the moving contacts (2*a*", 2*b*", 2*c*"), as can be observed in FIG. 10B, for example.

On the other hand, all the fixed contacts of the two switch assemblies (1, 4), are conveniently mounted in fixed positions of the casing (8, 8") for being contacted by the respective moving contacts.

Another aspect of the invention relates to the shape of the moving contacts (2*a*", 2*b*", 2*c*") of the first switch assembly, which is shown in FIGS. 4 to 14. These moving contacts (2*a*", 2*b*", 2*c*") are a substantially sinusoidal-shaped or substantially S-shaped metal plate, as shown in FIG. 10D, so that the final segments (18, 18") have a certain capacity to bend towards the central point of the plate, so that when they contact with the respective fixed contacts they apply certain pressure against them that assures electric contact. Furthermore, the free ends (19, 19") of these end segments (18, 18") are rounded so that the contact surface with the respective fixed contacts is minimal because those ends are the point where the greatest wear takes place due to the sparking causing the arc.

Unlike the embodiment of FIG. 3, in this case because the moving contacts move following a helicoidal path, the position, configuration and number of fixed contacts (2*a*", 2*b*", 2*c*"), to obtain the connection in series of the moving contacts (2*a*", 2*b*", 2*c*") is different. The moving contacts (2*a*", 2*b*", 2*c*") and their respective fixed contacts (2*a*", 2*b*", 2*c*", 3"), are configured and positioned such that they come into contact but in a sliding manner, i.e., they contact with one another at the same time that they slide as the first rotor (15) moves. Furthermore, in this embodiment there are five moving contacts (2*a*", 2*b*", 2*c*", 2*d*", 2*e*"), i.e., more moving contacts than pairs of fixed contacts.

The pairs of fixed contacts (2*a*", 2*b*", 2*c*") are placed on a plane (Y), as can more clearly be seen in FIG. 10B for example, and such that one of the contacts of each pair of fixed contacts (2*a*", 2*b*", 2*c*") is placed in one side of the rotor, and the other contact of the same pair is placed in the other side of the rotor. A first group of fixed contacts is therefore formed in the upper part of the switch (as depicted in FIG. 10), which are aligned according to a straight line parallel to the axis (X), and a second group of fixed contacts is therefore formed in the lower part of the switch (as depicted in FIG. 10), which are aligned according to a straight line parallel to the axis (X).

The fixed contacts (2*a*", 2*b*", 2*c*") are in the form of a plate, and one of them is connected with the connection terminal (5) and another one is connected with the other connection terminal (6). In this embodiment, there are three fixed contacts on one side of the axis X, another three on the other side of the axis X, and five moving contacts.

The pair of fixed contacts (3") of the delayed breaker element (3) is connected respectively with the terminals (5, 6) and has one end in the form of a tongue suitable for being introduced into the ends in the form of a clamp of the moving contact (3") described above. Another characteristic aspect of these fixed contacts (3") is their displaced or shifted position in relation to the position of the fixed contacts (2*a*", 2*b*", 2*c*") of the first switch assembly, because one of these fixed contacts (3") is aligned on a plane (Z) positioned on one side of the plane (Y) and parallel to same, whereas the other fixed contact (3") is aligned on a plane (R) and parallel to same, positioned on the other side of the plane (Y). The moving contact (3") of the delayed breaker element (3) is placed in the same angular position as the moving contacts (2*a*", 2*b*", 2*c*", 2*d*", 2*e*"), as can be observed in FIG. 10B, although it has a different shape.

Said displaced position of the fixed contacts (3") makes the delayed breaker element (3) close after the breaker elements of the first switch assembly. In other embodiments, that same function can be obtained in another way, for example by moving back the position of the moving contact (3") and aligning the fixed contacts (3") with the fixed contacts of the first switch assembly.

The helicoidal movement of the moving contacts (2*a*", 2*b*", 2*c*", 2*d*", 2*e*") is depicted in the sequence of FIGS. 10 to 14, where it can be seen that as they rotate clockwise around the axis (X), they move closer to the pairs of fixed contacts (2*a*", 2*b*", 2*c*") while at the same time the move forward longitudinally in the direction of the axis (X).

Figure 10A:
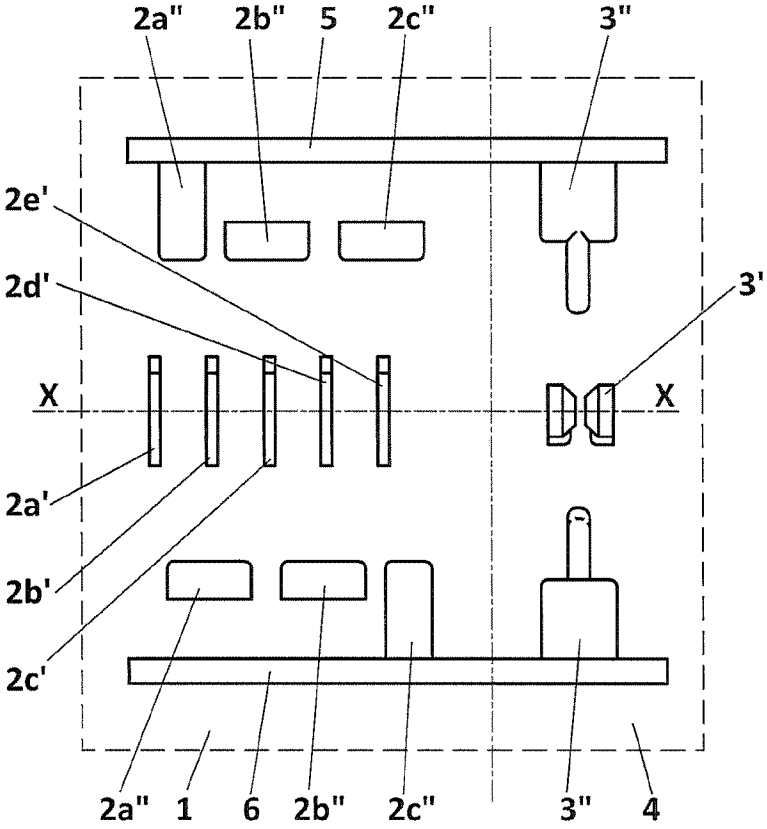

In FIG. 10 the moving contacts are at 0° with respect to a horizontal plane (P), and both switch assemblies (1, 4) are open. In this position, the gap (d) between the moving contacts and their respective fixed contacts is maximum for both switch assemblies, which can be more clearly seen in view of FIG. 10B. As the rotor (15) starts to move in a helicoidal manner, it rotates about the axis (X) in a clockwise direction, as seen in FIG. 10B, while at the same time it moves forward on the axis X towards the right, as seen in FIG. 10A, such that all the moving contacts gradually move closer to the fixed contacts.

Figure 11A:
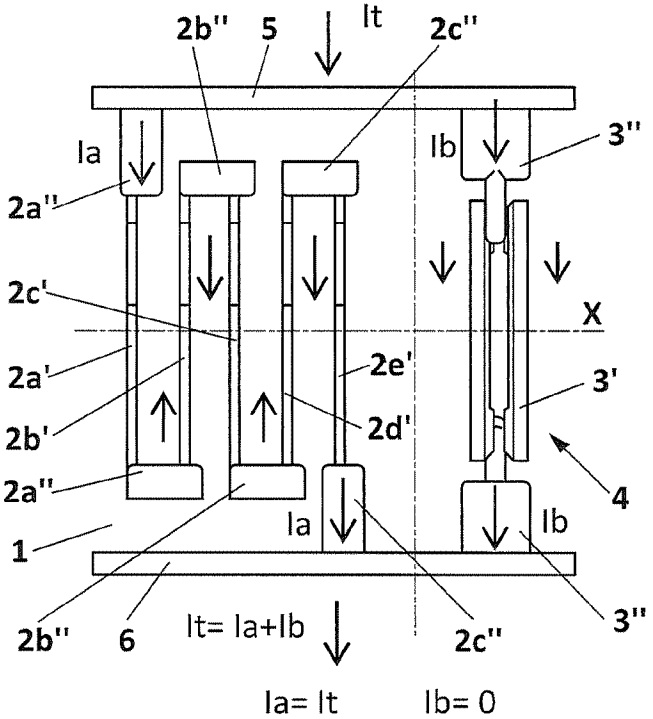
FIGS. 11A and 11C shows a depiction similar to that of FIG. 10 corresponding to a 55° rotational position of the rotors with respect to a horizontal plane (P).
Figure 11B:
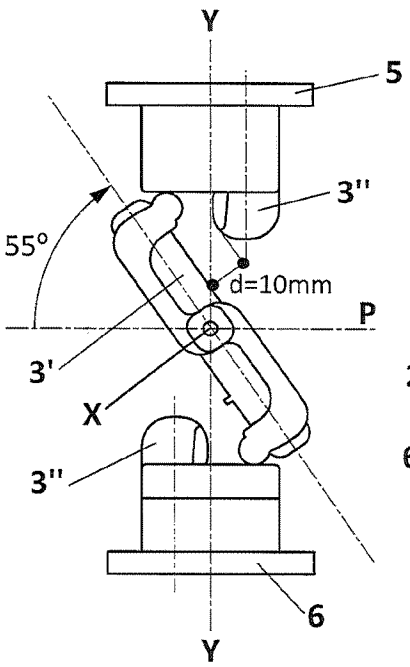
FIG. 11B is a front elevational view.
Figure 11C:
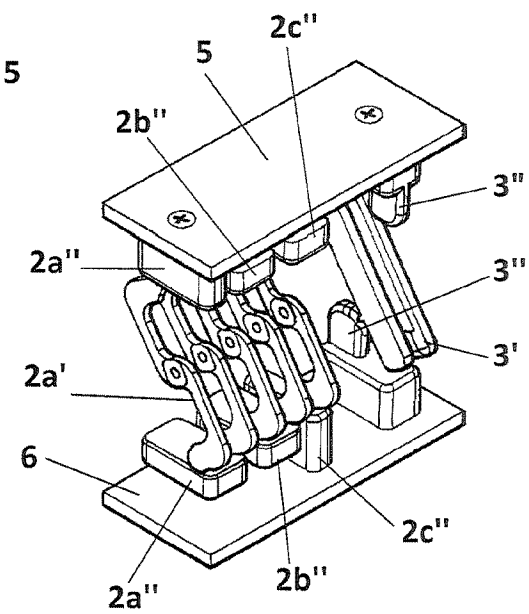

In FIG. 11 the rotor (15) (no shown) has rotated about 55°, and in this position (for this specific design shown in Figure) the moving contacts (2*a*', 2*b*', 2*c*') of the first switch assembly (1) come into contact with a fixed contact (2*a*", 2*b*", 2*c*"), whereas the delayed contact of the second switch assembly still has about 10 mm to reach its respective fixed contacts, because the fixed contacts of the second switch assembly are further away. As can be observed in FIG. 11 A, the position of the fixed and moving contacts of the first switch assembly is such that upon coming into contact, the moving contacts are connected to one another in series through the fixed contacts at the same time they slide over them as the rotor moves, and all the current of the switch (It) passes through the first switch assembly (Ia), and the current passing through the second switch assembly (Ib) is zero. In this case, the fixed contacts are placed such that in some of the fixed contacts, they contact with two moving contacts.

Figures 12A, 12B, 12C:
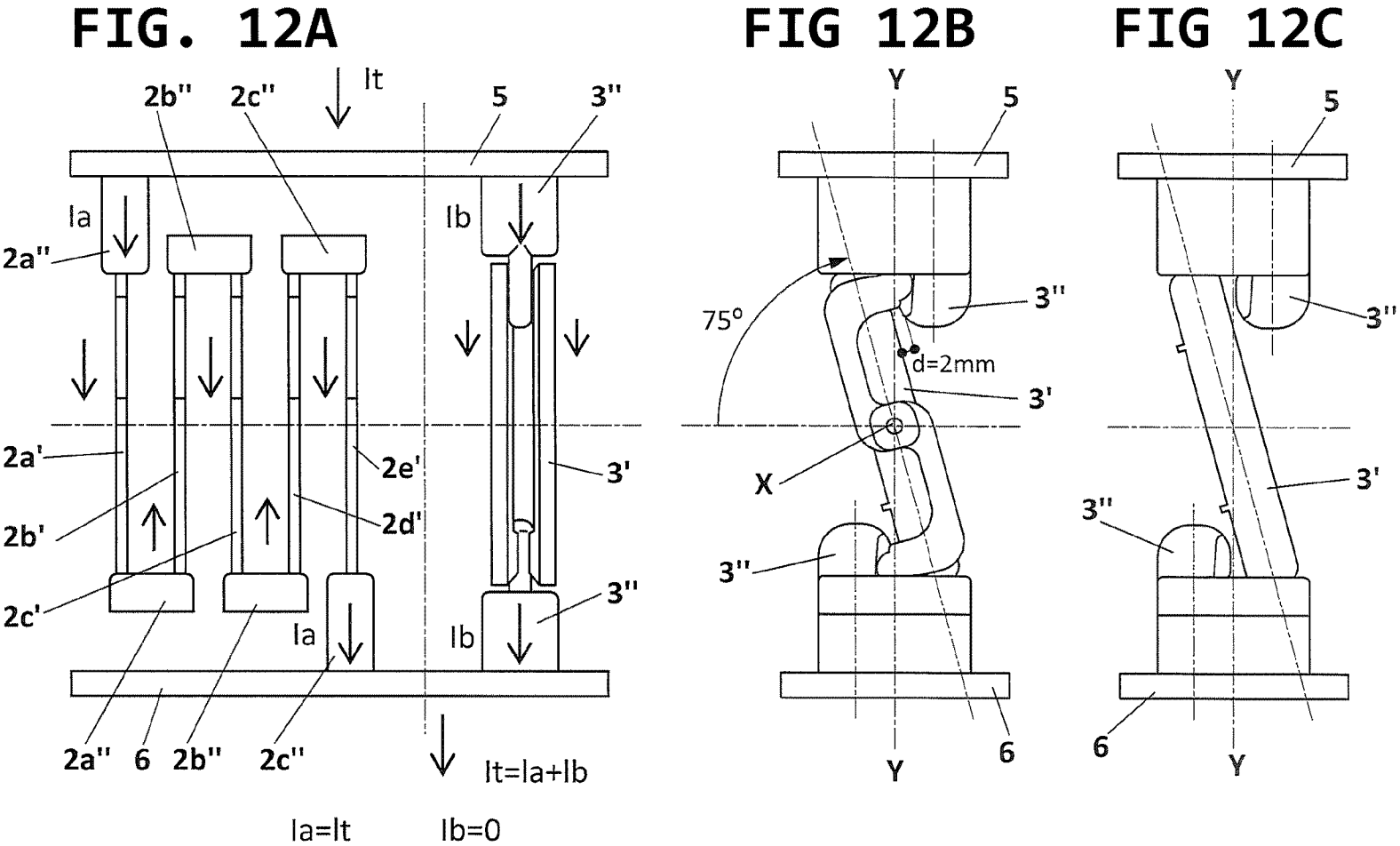
FIGS. 12A-12E show a depiction similar to that of FIG. 10 but corresponding to a 75° rotational position of the rotors with respect to a horizontal plane (P).
Figure 12E:
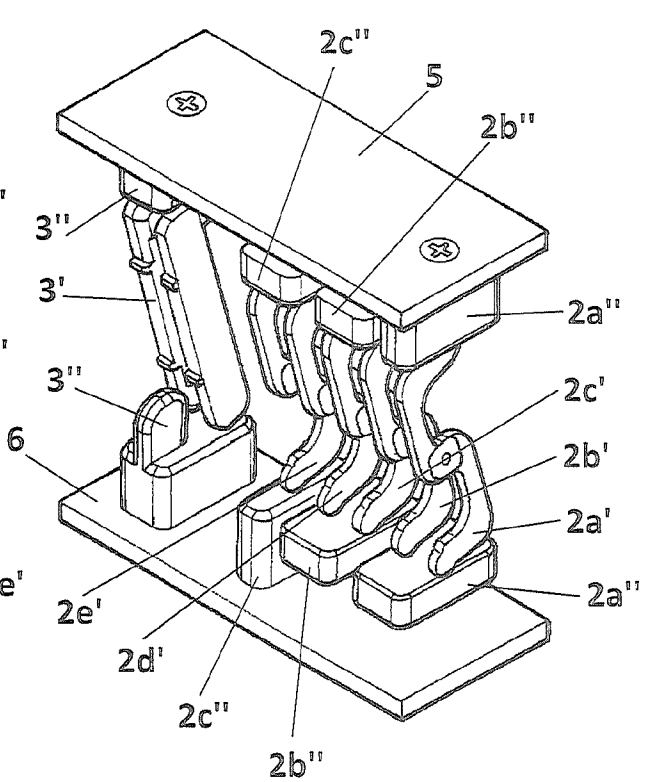
Figure 12D:
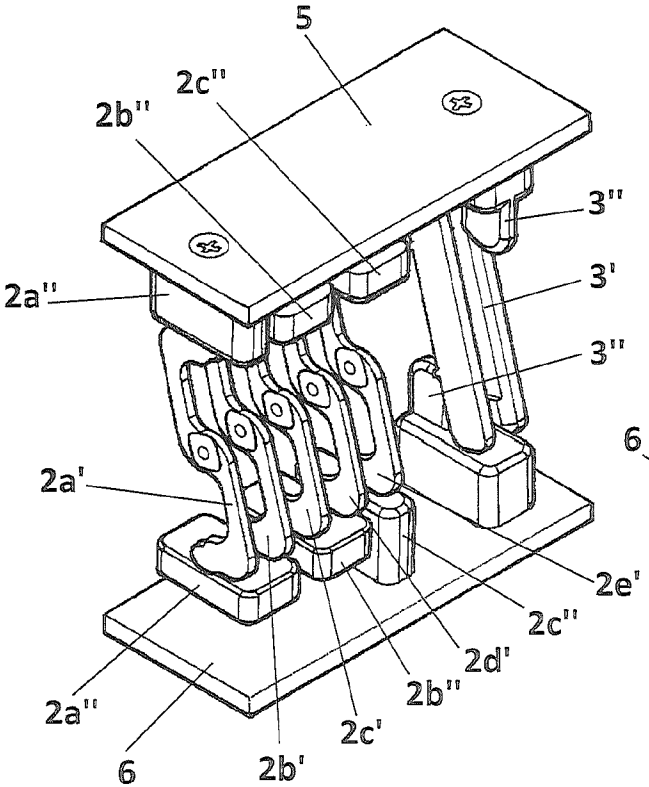
Figure 13A:
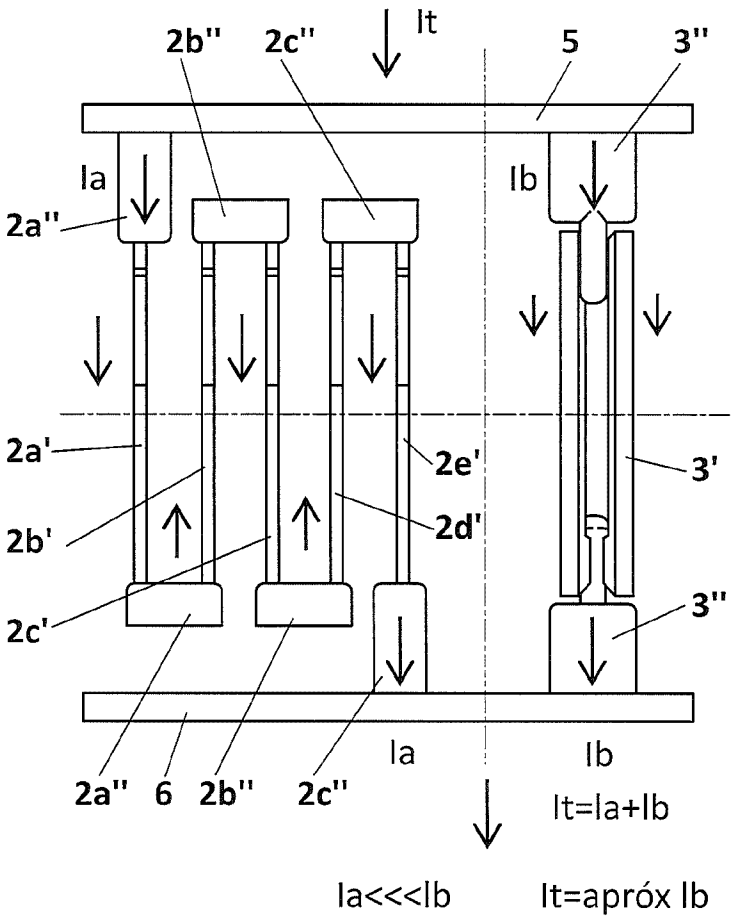
FIGS. 13A-13E shows a depiction similar to that of FIG. 12 corresponding to a 90° rotational position of the rotors.
Figure 13B:
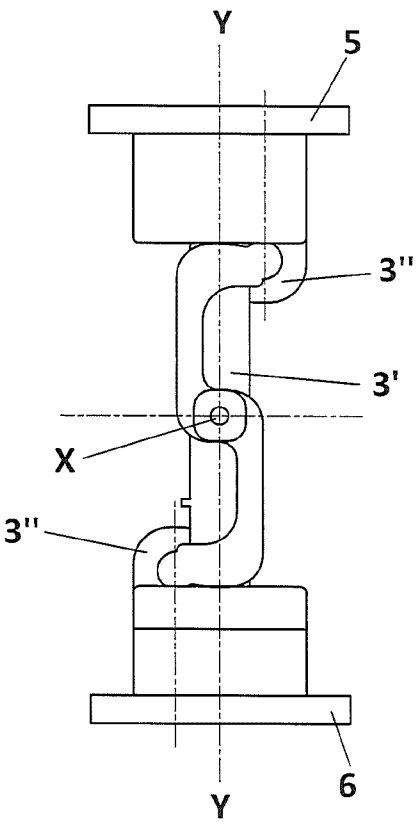
Figure 13C:
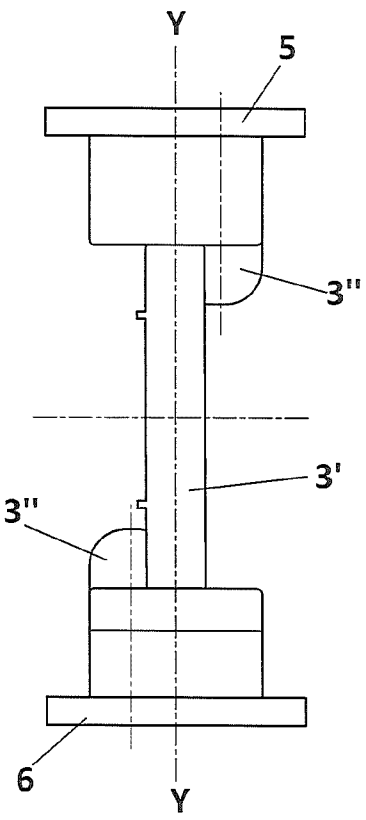
Figure 13D:
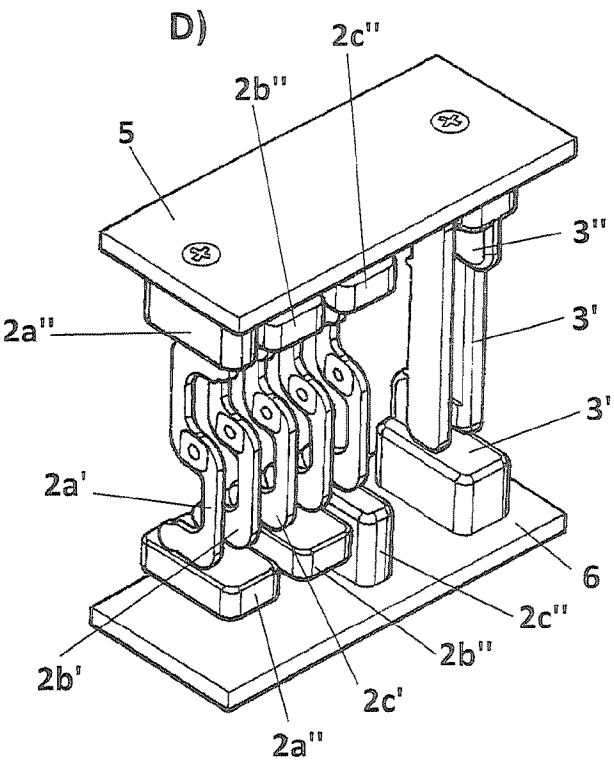
Figure 13E:
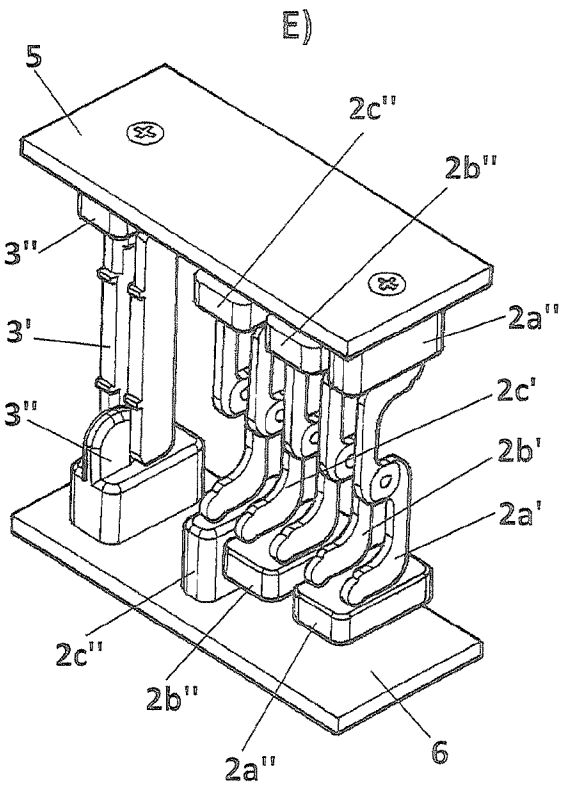

In FIG. 12 the first rotor (15) has rotated about 75° and in this position the moving contacts (2*a*', 2*b*', 2*c*') of the first switch assembly (1) are in contact with the fixed contacts (2*a*", 2*b*", 2*c*"), having increased the contact surface between both, whereas the delayed contact still has about 2 mm to reach the fixed contacts, and therefore (It=Ia), (Ib=0), (It=Ia+Ib).

In FIG. 13, the first rotor (15) has rotated about 90° from plane P, and in this position the moving contacts (2*a*', 2*b*', 2*c*') are still in contact with the fixed contacts (2*a*", 2*b*", 2*c*"), and the delayed contact (3') has already contacted with its respective fixed contacts (3"), i.e., all the breaker elements of the switch are closed, so now current then flows through the second switch assembly and (It=about Ib), (Ia<<<Ib), (It=Ia+Ib).

Figures 14A, 14B, 14C, 14D, 14E, 14F:
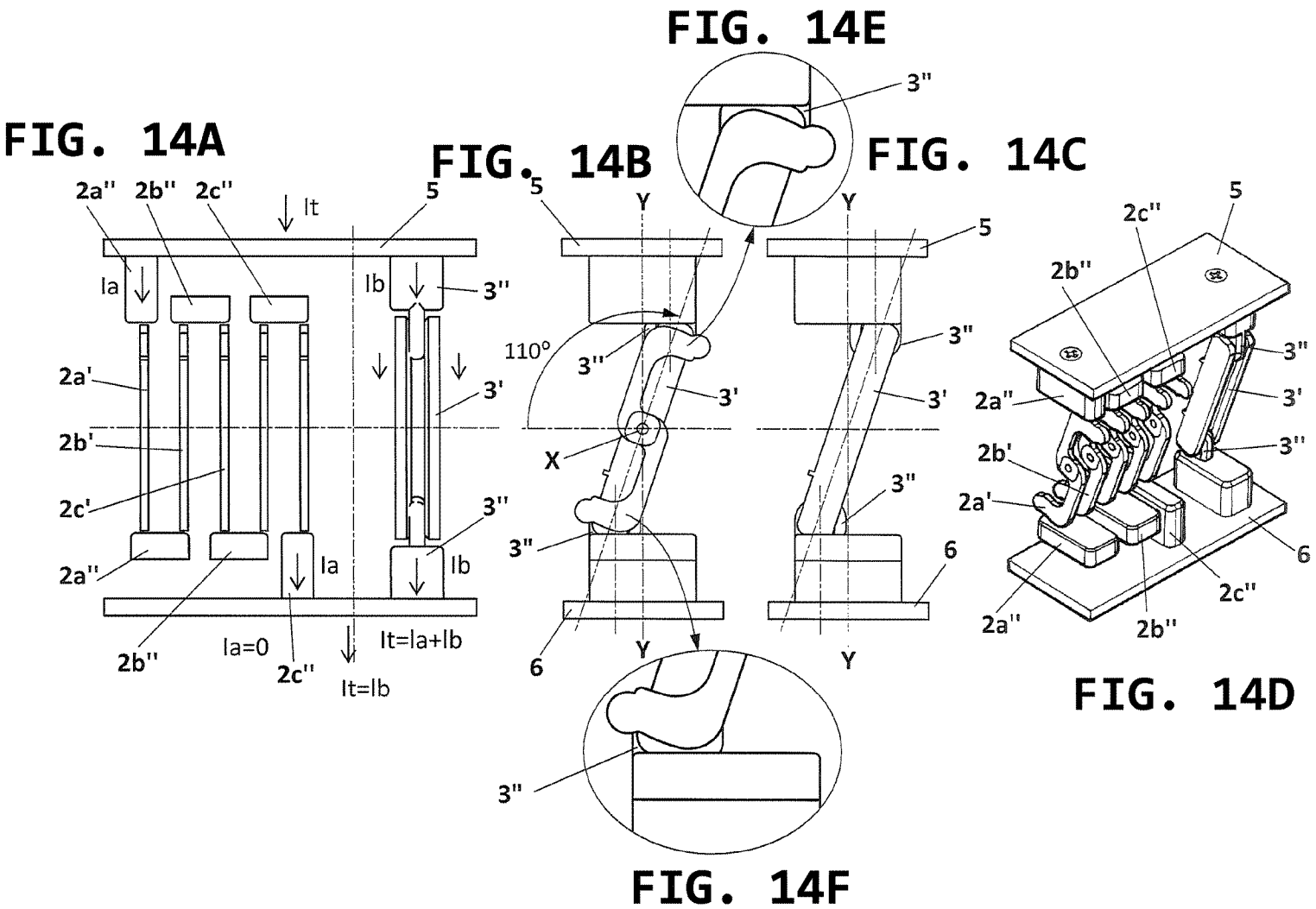
FIGS. 14A-14F show a depiction similar to that of FIG. 13 corresponding to a 110° rotational position of the rotors with respect to a horizontal plane (P).
Figure 15A:
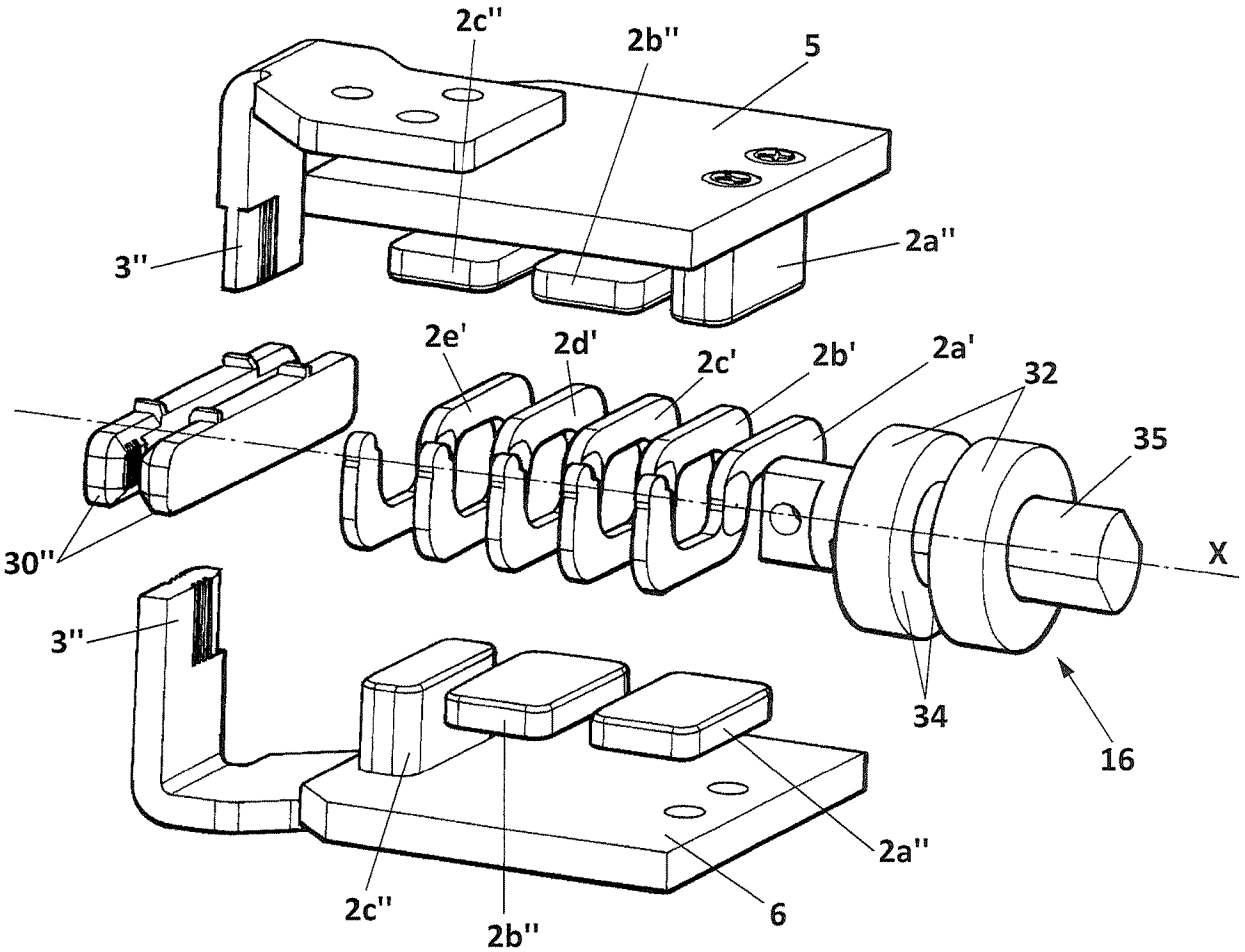
FIGS. 15A-15C show several views of an alternative embodiment of a switch according to the invention, in which the movement of the rotor is simply rotational about an axis but without linear movement. In this drawing the moving contacts are in 0° position with respect to a plane P.
Figure 15C:
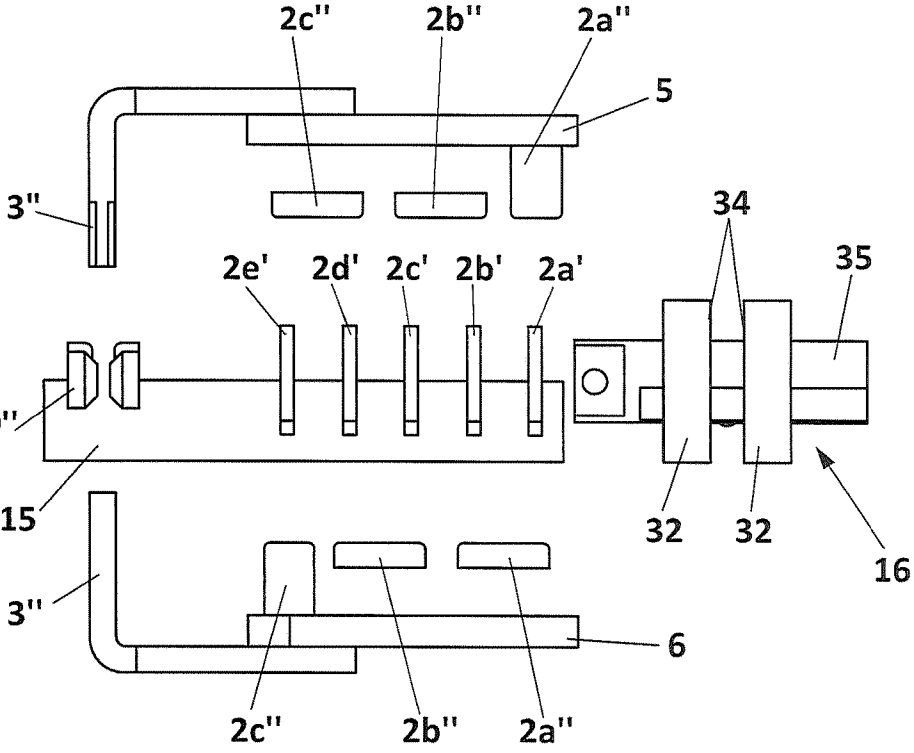
Figure 15B:
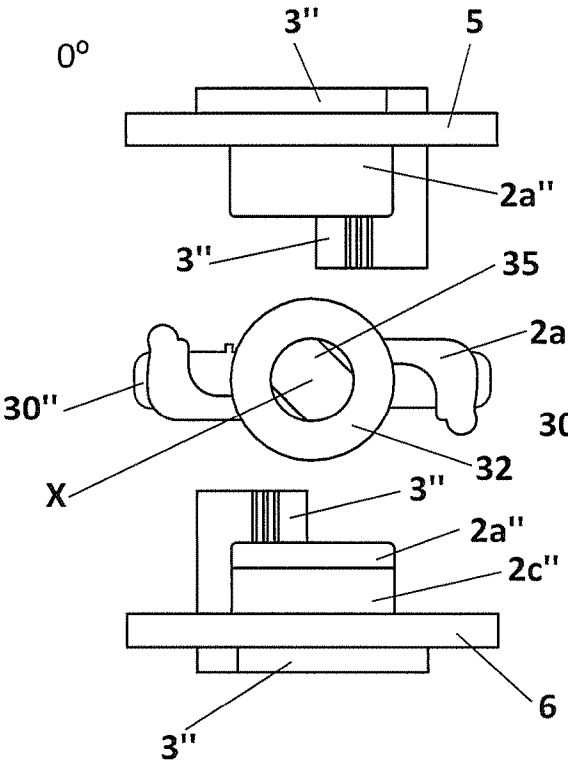
Figures 16A, 16B, 16D:
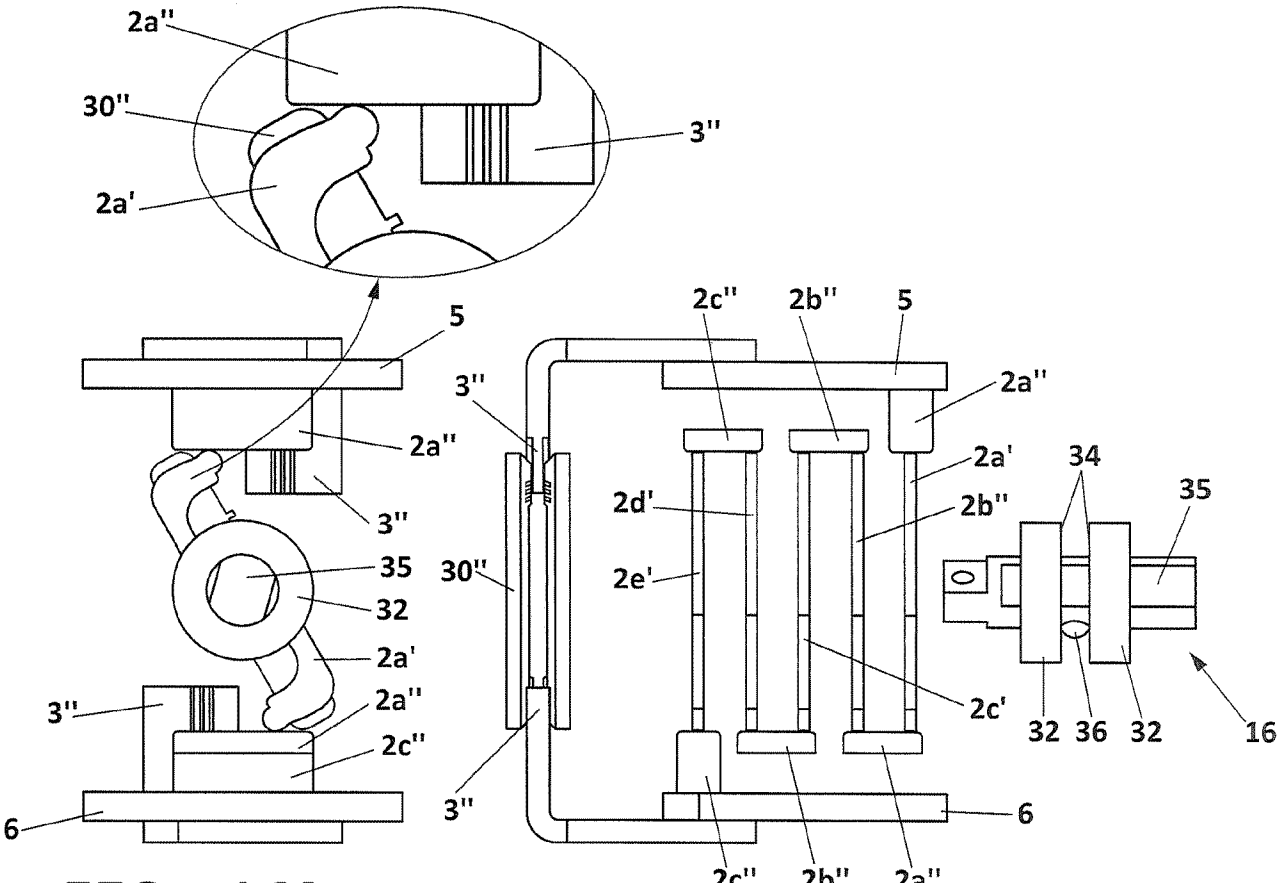
FIGS. 16A-16E show several views of the embodiment of FIG. 15 in which the moving contacts are at 60°, and in which the breaker elements of the first switch assembly are closed, and the delayed contact is still not closed.
Figure 16C:
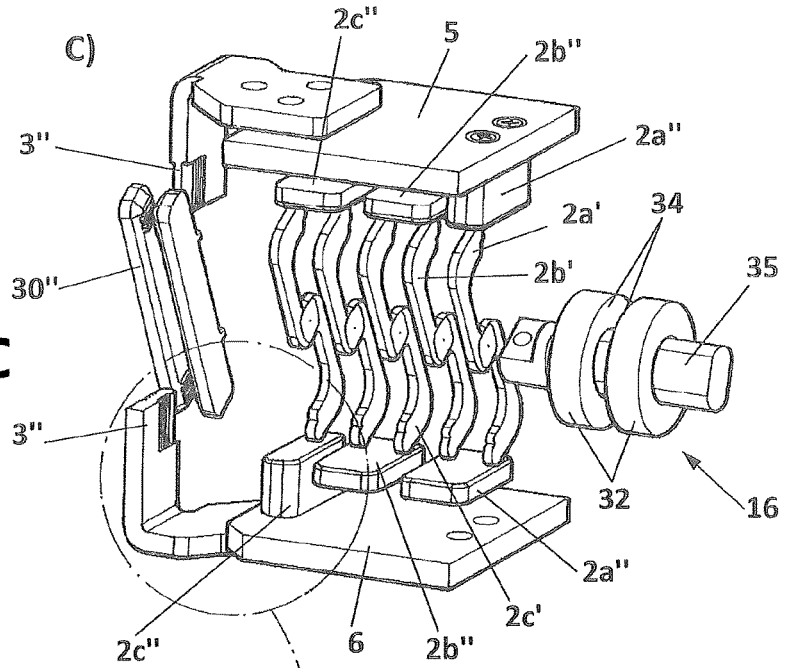
Figure 16E:
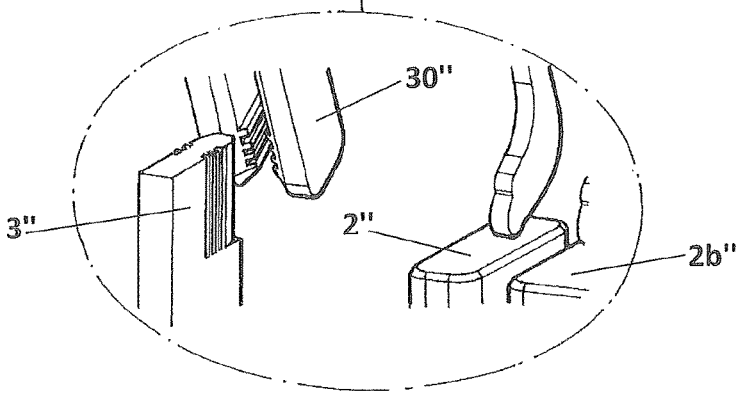
Figures 17A, 17B:
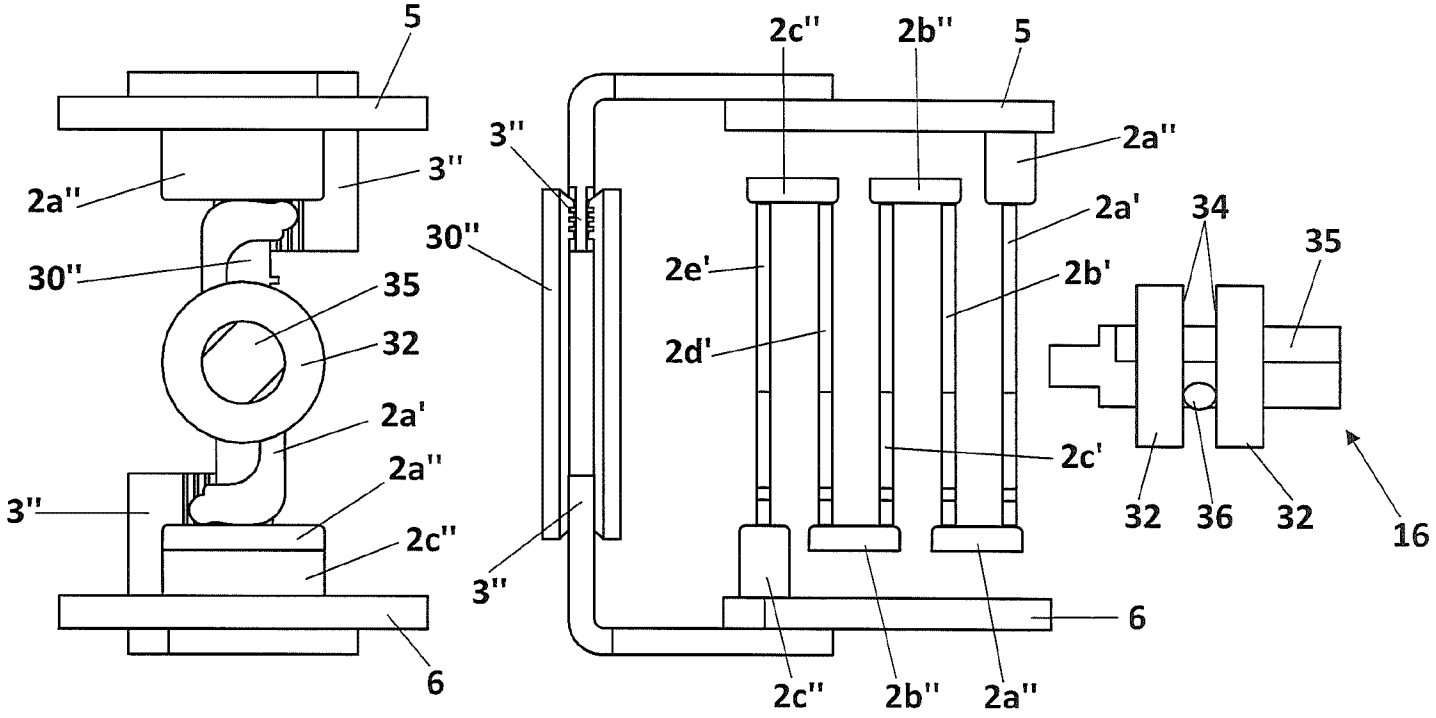
FIGS. 17A-17C show several views of the embodiment of FIG. 15, in which the moving contacts are at 90°, in which both the breaker elements of the first switch assembly and the delayed contact are closed.
Figure 17C:
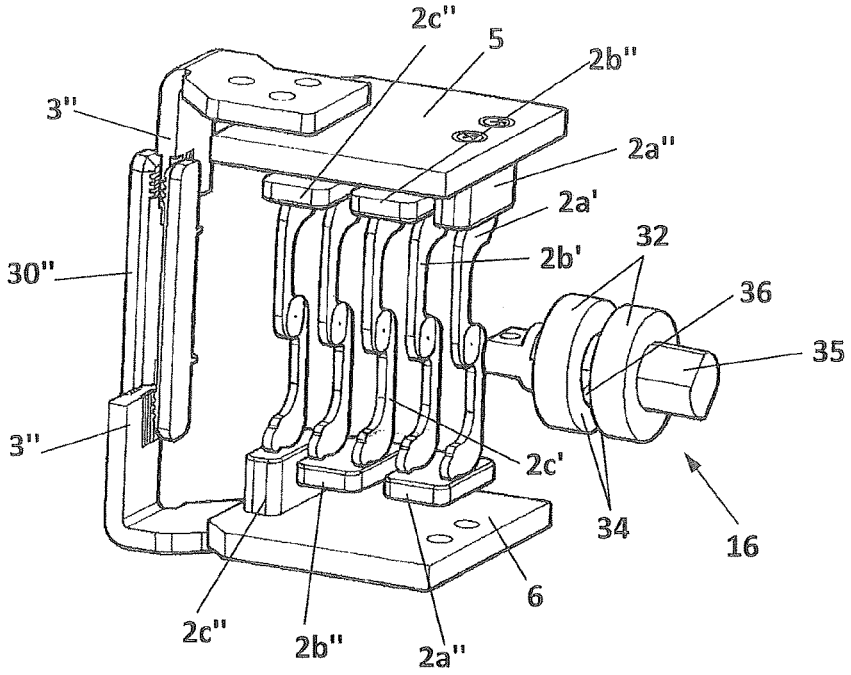
Figure 18B:
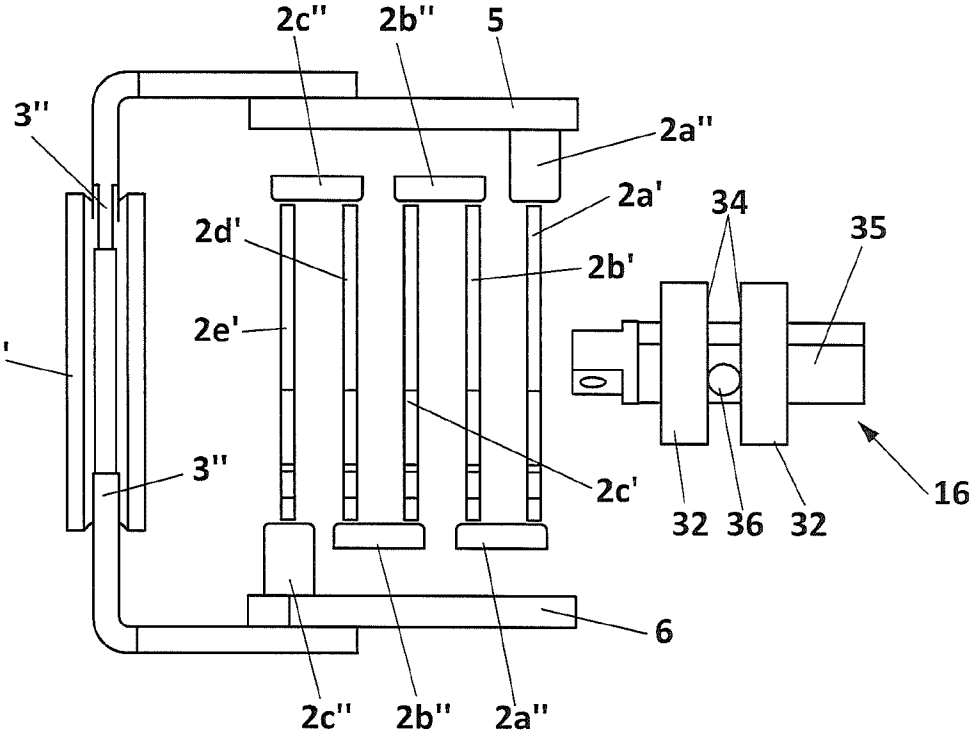
FIGS. 18A-18C show several views of the embodiment of FIG. 15, in which the moving contacts are at 110°, and in which the breaker elements of the first switch assembly are open, and the delayed contact is closed.
Figure 18A:
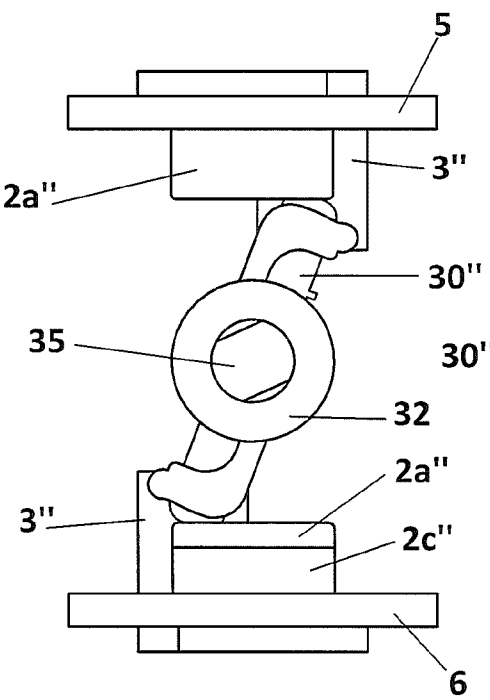
Figure 18C:
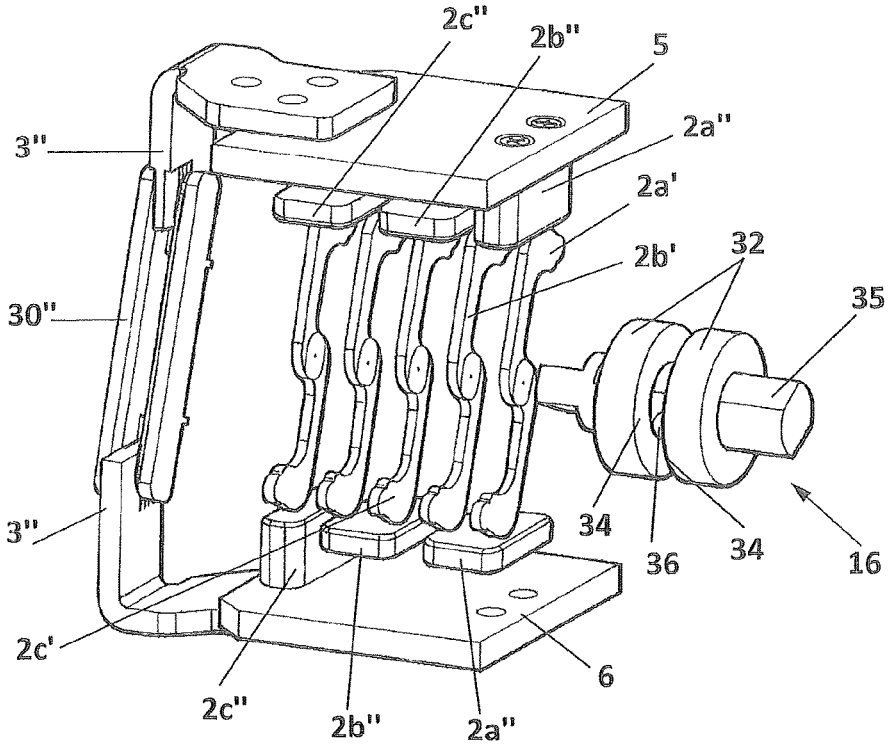

In FIG. 14, the first rotor (15) has rotated about 110° and in this position the moving contacts (2*a*', 2*b*', 2*c*') are no longer contacting the fixed contacts and therefore the first switch assembly opens, whereas the delayed contact (3') is coupled completely with its respective fixed contacts (3"), reducing their electrical resistance to a minimum, getting all the electric current to then flow through the second switch assembly, and (It=Ib), (Ia=0), (It=Ia+Ib). When the first rotor reaches 110°, it does not rotate anymore and stops in that position, which is achieved by means of the external actuation mechanism.

The sequence of FIGS. 10 to 14 shows the movement of the rotors and contacts during a switch closing operation. In an opening operation to interrupt current flow, the same movements occur but in the opposite direction, i.e., from FIG. 14 to FIG. 10.

In other embodiments, it may be of interest for the first rotor to not move helically, but rather to simply rotate on the axis (X) without moving longitudinally. That is the case of the embodiment shown in FIGS. 15 to 18, in which all the moving contacts of the first and the second switch assembly rotate at the same time around the axis (X), but each of them stays on one and the same plane. The design of the switch of this embodiment can be similar or even identical to the design of the switch of FIGS. 4 to 14, for which purpose the previously described actuation mechanism (16) must simply be changed so that it can cause rotation instead of helicoidal movement. To that end, making the guide surfaces (34) orthogonal to the axis (X) is sufficient.

In this embodiment, the first and the second rotor are completely integral with one another because both move in the same way, rotating on the axis (X) without axial movement, so they functionally act like one and the same body. Therefore, in a practical embodiment a single rotor (15) can be arranged in which the moving contacts of the first and the second switch assembly are mounted, as shown by way of example in FIG. 15C.

Otherwise, operation of the switch of FIGS. 15 to 18 is the same as operation of the switch of FIGS. 4 to 14, so the part of this description referring to those FIGS. 4 to 14 also applies to FIGS. 15 to 18.

The invention therefore achieves a helicoidal or angular elongation of the length of the electric arc in a small space, which means that for one and the same nominal interruption current, the switch can be smaller when compared with a switch from the state of the art.

As a result of the helicoidal or angular movement tangential speed of the interruption point is increased depending on the radius of rotation, thereby increasing the interruption speed in a simple manner, without requiring complex mechanisms and with a small number of parts, so manufacturing the switch is very simple.

One of the advantages of this embodiment is that since there is not contact or impact between the rotor and any other component of the switch, the rotor can be manufactured with materials such as glass or porcelain, which are highly insulating materials compared with plastic insulating materials.

The various embodiments and alternatives herein described can be combined with one another, giving rise to other embodiments, such as those obtained with the multiple combinations of the attached claims, for example.

What is claimed is:

1. An electric switch comprising:

a first and a second connection terminals for connecting the switch to an external circuit;

a first switch assembly comprising two or more electric breaker elements connected in series to one another and to the first and the second connection terminals;

a second switch assembly comprising at least one delayed electric breaker element connected in parallel to the first switch assembly, wherein the second switch assembly is adapted so that it has less electrical resistance than the first switch assembly; and a moving actuator made of insulating material associated with the first and the second switch assembly to open or close them, wherein the moving actuator is movable between a closed switch position in which electrical continuity is established between the first and the second connection terminals, and an open position in which current flow between said terminals is prevented, wherein the second switch assembly is configured for being closed in the switch closing operation after the first switch assembly closes, such that when the second switch assembly is closed, the first switch assembly is short-circuited, and wherein the first switch assembly is constructed such that the two or more electric breaker elements open and close simultaneously.

2. The electric switch according to claim 1, wherein the electric breaker elements of the first switch assembly comprise two fixed contacts and one moving contact that can be contacted on the fixed contacts in a sliding manner, and wherein the at least one delayed electric breaker element of the second switch assembly comprises two fixed contacts and one moving contact that can be connected with the two fixed contacts, and wherein the second switch assembly has fewer electric breaker elements connected in series between the connection terminals than the first switch assembly, such that the second switch assembly has less electrical resistance than the first switch assembly.

3. The electric switch according to claim 2, wherein the second switch assembly is configured such that the path the moving contact of the second switch assembly must travel until contacting with its respective fixed contacts is longer than the path that the moving contacts of the first switch assembly must travel until contacting with its respective fixed contacts, such that in the electrical switch closing operation, the second switch assembly closes after the first switch assembly closes.

4. The electric switch according to claim 2, wherein the moving contacts of the first switch assembly are a substantially sinusoidal-shaped or substantially S-shaped metal plate.

5. The electric switch according to claim 1, configured so that the moving actuator can be moved with at least one linear movement component along an axis (X).

6. The electric switch according to claim 1, configured so that the moving actuator can rotate about an axis (X) and on a plane transverse to said axis.

7. The electric switch according to claim 1, wherein the moving contacts of the first and the second switch assembly are mounted in said moving actuator, such that they can move jointly with same.

8. The electric switch according to claim 1, comprising a casing made of electrically insulating material, and wherein the connection terminals and the fixed contacts of the first and the second switch assembly are mounted in said casing, and wherein the moving actuator is movably mounted in the casing.

9. The electric switch according to claim 1, wherein the moving actuator is an elongated slide and is linearly movable along an axis (X), and is arranged longitudinally according to the direction of said axis (X), and wherein the moving contacts of the first and the second switch assembly have two ends and are mounted in the slide, such that a first end of each moving contact projects from a first side face of the slide, and a second end of each moving contact projects from a second side face of the slide opposite the first face, and wherein the fixed contacts of the first and the second switch assembly are facing one another in pairs and placed on opposite sides of the slide in order to be contacted by its associated moving contact.

10. The electric switch according to claim 1, wherein the moving actuator is a rotor having an elongated body which is movably mounted inside a casing, and wherein the switch incorporates means for rotating the rotor inside the casing about an axis (X) without axial movement, and wherein the moving contacts of the first switch assembly are mounted in said rotor and are jointly movable with the rotor.

11. The electric switch according to claim 10, wherein the moving contacts of the first switch assembly are identical and are mounted in a same angular position in the rotor with respect to the axis (X), and wherein each moving contact has a first and a second end and is configured such that said ends can be accessed from diametrically opposing points outside the rotor with respect to the axis (X).

12. The electric switch according to claim 10, wherein a first group of fixed contacts of the first switch assembly are aligned according to a straight line parallel to the axis (X) in one side of the rotor, and a second group of fixed contacts of the first switch assembly are aligned according to a straight line parallel to the axis (X) in the other side of the rotor, and wherein one of the fixed contacts of the first group is connected with a connection terminal, and another one of the fixed contacts of the second group is connected with another connection terminal.

13. The electric switch according to claim 10, wherein the moving contacts of the first switch assembly are a substantially sinusoidal-shaped or substantially S-shaped metal plate.

14. The electric switch according to claim 1, wherein the moving actuator comprises a first rotor in which the moving contacts of the first switch assembly are mounted, and a second rotor in which the at least one moving contact of the second switch assembly is mounted, wherein the first rotor is helically movable with respect to said axis (X), and wherein the second rotor is mounted coaxially to the first rotor with respect to said axis (X) and is rotatable about said axis (X) on one and a same plane, and wherein the first and the second rotor are coupled to one another such that can rotate at a same time about the axis (X).

15. The electric switch according to claim 14, wherein the moving contacts of the first switch assembly are identical and are mounted in a same angular position in the rotor with respect to the axis (X), and wherein each moving contact has a first and a second end and is configured such that said ends can be accessed from diametrically opposing points outside the rotor with respect to the axis (X).

16. The electric switch according to claim 14, wherein the moving contacts of the first switch assembly are a substantially sinusoidal-shaped or substantially S-shaped metal plate.

17. A method for controlling electric current flow through an electric line using the electric switch defined in claim 1, which comprises:

connecting in series in said line the first switch assembly formed by the two or more electric breaker elements connected to one another in series, connecting the second switch assembly in parallel to the first switch assembly, wherein said second switch assembly has less electrical resistance than the first switch assembly, simultaneously closing the breaker elements of the first switch assembly to allow current flow through the electric line, keeping the second switch assembly open, and closing the second switch assembly after an established time period to short-circuit the first switch assembly, such that the electric current in the line then flows through the second switch assembly.

18. The method according to claim 17, which further comprises opening the second switch assembly while the breaker elements of the first switch assembly are closed, such that the current in the line then flows in its entirety through the first switch assembly, and then simultaneously opening the breaker elements of the first switch assembly to interrupt current flow through the electric line.

19. The method according to claim 17, wherein the second switch assembly comprises at least one electric breaker element connected in parallel to the first switch assembly, and wherein the electric breaker elements of the first and the second switch assembly respectively comprise at least two fixed contacts and one moving contact that can be connected with the associated fixed contacts, and wherein the method comprises simultaneously moving the moving contacts of the electric breaker elements of the first and the second switch assembly.

20. The method according to claim 17, which further comprises simultaneously moving each moving contact of the electric breaker elements of the first switch assembly linearly along an axis X, or helically with respect to an axis X, or rotationally on one and a same plane and with respect to an axis X.

21. The method according to claim 17, which further comprises moving the at least one moving contact of the second switch assembly simultaneously with the moving contacts of the first switch assembly, and wherein the moving contacts of the first and the second switch assembly move linearly along an axis X, or wherein the moving contacts of the first and the second switch assembly move helically or rotationally with respect to an axis X, and the moving contact of the second switch assembly moves rotationally on one and a same plane and on said axis X.

22. The method according to claim 17, which comprises actuating the first and the second switch assembly by means of one and the same moving actuator common to both switch assemblies, and wherein the first and the second switch assembly are part of the same switching device and are mounted inside one and a same casing.

* * * * *